US011703785B2

(12) United States Patent
Komatsu et al.

(10) Patent No.: US 11,703,785 B2
(45) Date of Patent: Jul. 18, 2023

(54) DECURLING DEVICE AND IMAGE FORMING APPARATUS

(71) Applicant: FUJIFILM Business Innovation Corp., Tokyo (JP)

(72) Inventors: Nobuyoshi Komatsu, Kanagawa (JP); Shingo Akiyama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 85 days.

(21) Appl. No.: 17/320,833

(22) Filed: May 14, 2021

(65) Prior Publication Data

US 2022/0113662 A1 Apr. 14, 2022

(30) Foreign Application Priority Data

Oct. 9, 2020 (JP) ..... 2020-171387

(51) Int. Cl.
*G03G 15/20* (2006.01)
*G03G 15/00* (2006.01)

(52) U.S. Cl.
CPC ..... *G03G 15/2064* (2013.01); *G03G 15/2053* (2013.01); *G03G 15/6576* (2013.01)

(58) Field of Classification Search
CPC ..... G03G 15/2064; G03G 15/2053; G03G 15/6576; G03G 15/2017
See application file for complete search history.

(56) References Cited

U.S. PATENT DOCUMENTS

2017/0129725 A1* 5/2017 Sasaki ..... B65H 5/068

FOREIGN PATENT DOCUMENTS

JP 3474345 B2 * 12/2003
JP 2016-164644 A 9/2016
JP 6344315 B2 * 6/2018 ..... B41J 11/0005

OTHER PUBLICATIONS

English machine translation of Kondo (JP 6344315 B2) (Year: 2018).*
English machine translation of Kameyama (JP 3474345 B2) (Year: 2003).*

* cited by examiner

*Primary Examiner* — Walter L Lindsay, Jr.
*Assistant Examiner* — Geoffrey T Evans
(74) *Attorney, Agent, or Firm* — Sughrue Mion, PLLC

(57) ABSTRACT

A decurling device includes: a rotary body; an endless correction belt configured to correct curl of a recording medium passing between the rotary body and the correction belt; and a pressure contact unit disposed inside the correction belt, an opposite surface of the pressure contact unit to the rotary body being supported by a support unit so as to be in pressure contact with the rotary body, in which a center portion, in an axial direction of the rotary body, of at least one of a contact portion of the pressure contact unit or a contact portion of the support unit further protrudes toward the other of the contact portion of the pressure contact unit and the contact portion of the support unit than both end portions thereof.

20 Claims, 18 Drawing Sheets

DECURLING DEVICE AND IMAGE FORMING APPARATUS

CROSS-REFERENCE TO RELATED APPLICATIONS

This application is based on and claims priority under 35 USC 119 from Japanese Patent Application No. 2020-171387 Filed Oct. 9, 2020.

BACKGROUND

(i) Technical Field

The present disclosure relates to a decurling device and an image forming apparatus.

(ii) Related Art

In the related art, for example, JP-A-2016-164644 has proposed a technique related to an image forming apparatus including a decurling device.

JP-A-2016-164644 discloses an image forming apparatus including a fixing device and a decurling device (decurler). The fixing device fixes a toner image onto a recording medium. The decurling device is disposed downstream of the fixing device in a transport direction of the recording medium. The decurling device corrects curl of the recording medium onto which the toner image has been fixed by the fixing device.

SUMMARY

Aspects of non-limiting embodiments of the present disclosure relate to a decurling device including a rotary body and a correction belt that is in pressure contact with the rotary body, and particularly relate to preventing a fluctuation of a pressure contact force in an axial direction of the rotary body when the pressure contact force between the rotary body and the correction belt is changed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a decurling device including: a rotary body; an endless correction belt configured to correct curl of a recording medium passing between the rotary body and the correction belt; and a pressure contact unit disposed inside the correction belt, an opposite surface of the pressure contact unit to the rotary body being supported by a support unit so as to be in pressure contact with the rotary body, in which a center portion, in an axial direction of the rotary body, of at least one of a contact portion of the pressure contact unit or a contact portion of the support unit further protrudes toward the other of the contact portion of the pressure contact unit and the contact portion of the support unit than both end portions thereof.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present disclosure will be described with reference to the accompanying drawings.

First Exemplary Embodiment

Figure 1:
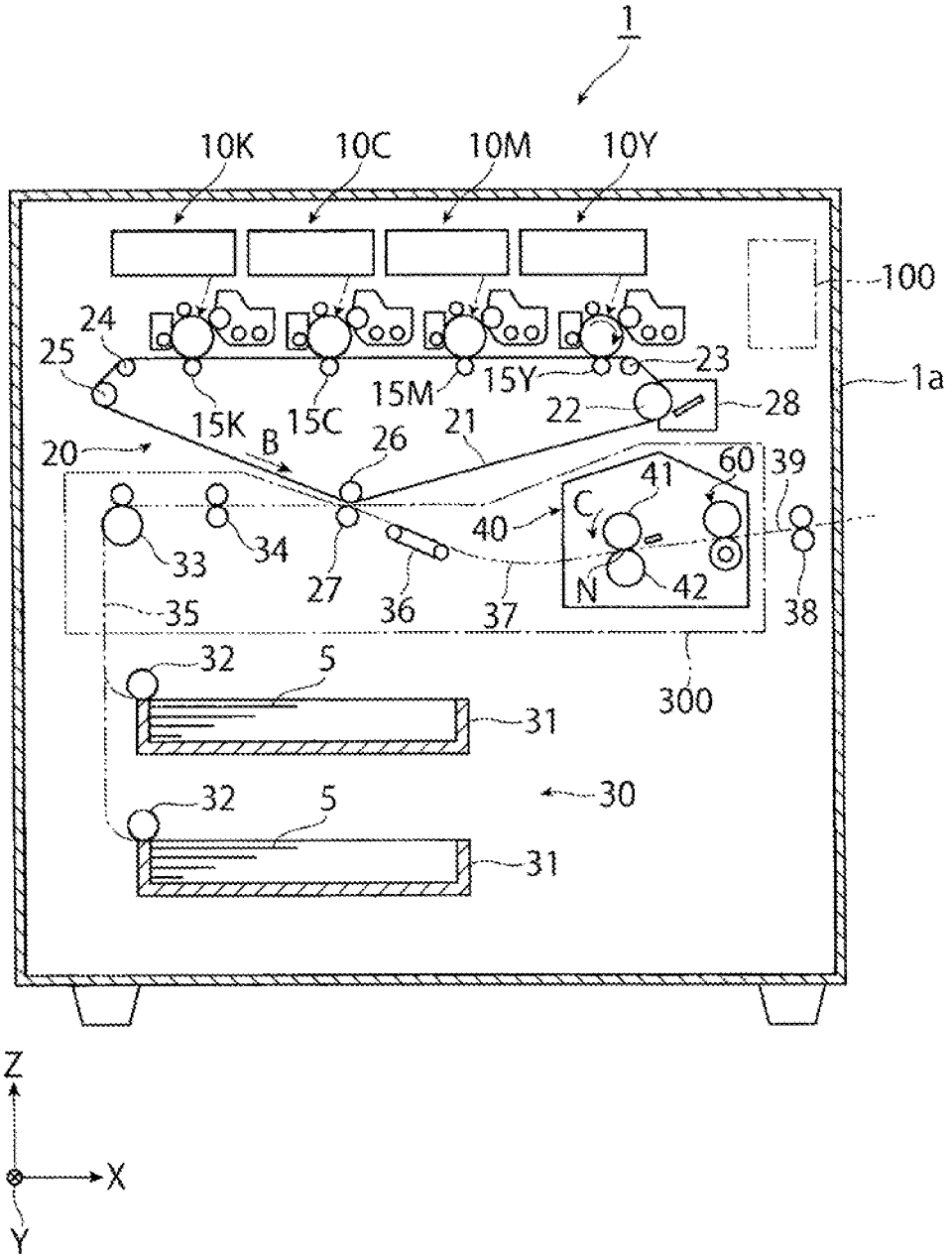
FIG. 1 illustrates an overall configuration of an image forming apparatus to which a decurling device according to a first exemplary embodiment of the present disclosure is applied.
Figure 2:
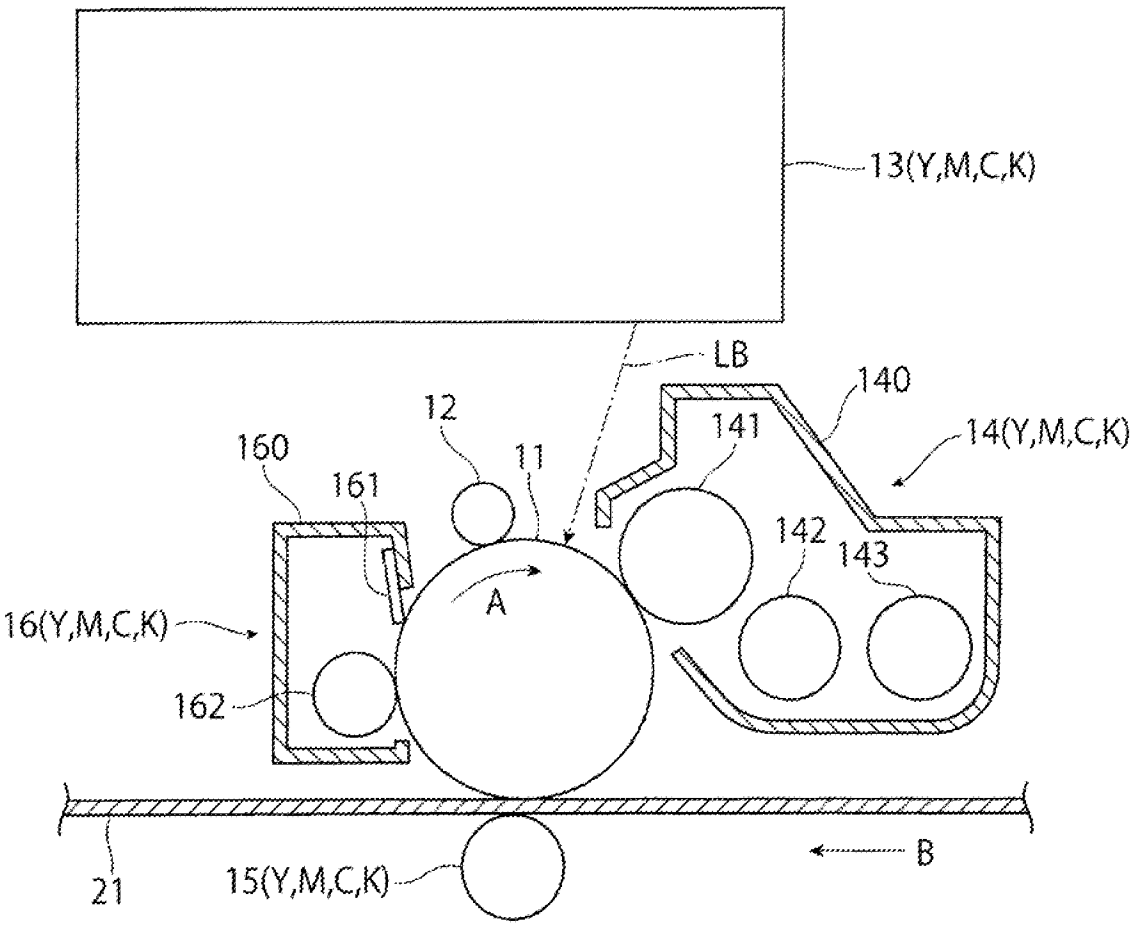
FIG. 2 illustrates an image forming device of the image forming apparatus to which the decurling device according to the first exemplary embodiment of the present disclosure is applied.

FIG. 1 is an overall view illustrating an image forming apparatus to which a decurling device according to a first exemplary embodiment of the present disclosure is applied. FIG. 2 illustrates an image forming device of the image forming apparatus. In FIG. 1, the reference sign "X" represents a width direction along a horizontal direction, "Y" represents a depth direction along the horizontal direction, and "Z" represents a vertical direction.

Overall Configuration of Image Forming Apparatus

An image forming apparatus 1 according to the first exemplary embodiment is, for example, a color printer. As illustrated in FIG. 1, the image forming apparatus 1 includes plural image forming devices 10, an intermediate transfer device 20, a sheet feeding device 30, and a fixing device 40. The image forming devices 10 form toner images that have been developed with toners that are developers. The intermediate transfer device 20 carries the toner images formed by the respective image forming devices 10 and finally transport the toner images to a secondary transfer position where the toner images are secondarily transferred to a recording sheet 5 (an example of a recording medium). The sheet feeding device 30 accommodates and transports the recording sheets 5 to be fed to the secondary transfer position of the intermediate transfer device 20. The fixing device 40 fixes the toner images, which have been secondarily transferred by the intermediate transfer device 20, onto the recording sheet 5. In FIG. 1, a reference numeral 1*a* denotes an apparatus body of the image forming apparatus 1. The apparatus body 1*a* includes a support structure member, an exterior cover, and the like. A two-dot chain line in the drawing indicates a main transport path. The recording sheet 5 is transported in the apparatus body 1*a* through the main transport path. In the first exemplary embodiment, the plural image forming devices 10 and the intermediate transfer device 20 constitute an image forming unit that forms an image on the recording sheet 5.

The image forming devices 10 include four image forming devices 10Y, 10M, 10C, and 10K that exclusively form toner images of four colors of yellow (Y), magenta (M), cyan (C), and black (K), respectively. The four image forming devices 10(Y, M, C, K) are arranged in a row in the horizontal direction in an internal space of the apparatus body 1*a*.

The four image forming devices 10 include the image forming devices 10(Y, M, C, K) of yellow (Y), magenta (M), cyan (C), and black (K). As illustrated in FIG. 2, each of the image forming devices 10(Y, M, C, K) includes a rotary photoconductor drum 11 (an example of an image carrier). Around the photoconductor drum 11, the following devices (an example of a toner image forming unit) are disposed. That is, the devices include a charging device 12, an exposure device 13, a corresponding one of developing devices 14(Y, M, C, K), a corresponding one of primary transfer devices 15(Y, M, C, K) (an example of primary transfer units), and a corresponding one of drum cleaning devices 16(Y, M, C, K). The charging device 12 charges a circumferential surface (image carrying surface) of the photoconductor drum 11 on which an image may be formed to a required potential. The exposure device 13 irradiates the charged circumferential surface of the photoconductor drum 11 with light based on image information (signal) to form an electrostatic latent image (for a corresponding one of colors) having a potential difference. The developing devices 14(Y, M, C, K) develop the electrostatic latent images with toners that are developers of corresponding colors (Y, M, C, K) to form toner images. The primary transfer devices 15(Y, M, C, K) transfer the toner images to the intermediate transfer device 20. The drum cleaning devices 16(Y, M, C, K) clean the image carrying surface of the photoconductor drum 11 by removing adhering substances such as toners remaining on the image carrying surface of the photoconductor drum 11 after the primary transfer.

The photoconductor drum 11 includes a cylindrical or columnar base material to be grounded and the image carrying surface. The image carrying surface of the photoconductor drum 11 includes a photoconductive layer made of a photoconductive material and formed on the circumferential surface of the base material. The photoconductor drum 11 is supported to rotate in a direction indicated by an arrow A by power transmitted from a driving device (not illustrated).

The charging device 12 includes a contact type charging roller that is in contact with the photoconductor drum 11. A charging voltage is supplied to the charging device 12. As the charging voltage, a voltage or a current having the same polarity as a charging polarity of the toners is supplied from the developing devices 14 when the developing devices 14 perform reversal development. As the charging device 12, a non-contact type charging device such as a scorotron that is not in contact with the surface of the photoconductor drum 11 may be used.

The exposure device 13 deflects laser light LB and performs scan along the axial direction of the photoconductor drum 11. The laser light LB is generated in accordance with image information input to the image forming apparatus 1. The exposure device 13 may include an LED print head that forms electrostatic latent images by irradiating the photoconductor drum 11 with light corresponding to the image information by using light emitting diodes (LEDs) as plural light emitting elements arranged along the axial direction of the photoconductor drum 11.

Each of the developing devices 14(Y, M, C, K) includes, in a housing 140, a developing roller 141, agitation transport members 142 and 143 (such as two screw augers), and layer thickness regulating member (not illustrated). The housing 140 has an opening and a developer accommodating chamber. The developing roller 141 carries the developer and transports the developer to a developing region facing the photoconductor drum 11. The agitation transport members 142 and 143 agitate the developer and transport the developer to pass through the developing roller 141. The layer thickness regulating member regulates an amount (layer thickness) of the developer carried by the developing roller 141. In the developing device 14, a developing voltage is supplied between the developing roller 141 and the photoconductor drum 11 from a power supply device (not illustrated). The developing roller 141 and the agitation transport members 142 and 143 are rotated in a predetermined direction by power transmitted from the driving device (not illustrated). Further, a two-component developer containing a non-magnetic toner and a magnetic carrier is used as the developers for the four colors.

Each of the primary transfer devices 15(Y, M, C, K) is a contact type transfer device including a primary transfer roller. The primary transfer roller rotates in contact with the circumference of the photoconductor drum 11 via an intermediate transfer belt 21. A primary transfer voltage is supplied to the primary transfer roller. As the primary transfer voltage, a DC voltage having a polarity opposite to the charging polarity of the toner is supplied from the power supply device (not illustrated).

Each of the drum cleaning devices 16 includes a container-shaped body 160, a cleaning plate 161, and a delivery member 162 (such as a screw auger). A part of the body 160 is opened. The cleaning plate 161 is in contact with the circumferential surface of the photoconductor drum 11 after the primary transfer at a predetermined pressure and removes and cleans up the adhering substances such as the residual toner. The delivery member 162 collects the adhering substances such as the toner removed by the cleaning plate 161 and delivers the adhering substances to a collection system (not illustrated).

As illustrated in FIG. 1, the intermediate transfer device 20 is disposed at a position below the image forming devices 10(Y, M, C, K) in the vertical direction Z. The intermediate transfer device 20 includes the intermediate transfer belt 21, plural belt supporting rollers 22 to 26, a secondary transfer device 27, and a belt cleaning device 28. The intermediate transfer belt 21 rotates in a direction indicated by an arrow B while passing through the primary transfer positions between the photoconductor drum 11 and the primary transfer devices 15 (primary transfer rollers). The belt supporting rollers 22 to 26 rotatably support the intermediate transfer belt 21 while holding the intermediate transfer belt 21 in a desired state from an inner surface thereof. The secondary transfer device 27 (an example of a secondary transfer unit) is disposed on an outer peripheral surface (image carrying surface) of the intermediate transfer belt 21 supported by the belt supporting roller 26. The secondary transfer device 27 secondarily transfers the toner images on the intermediate transfer belt 21 to the recording sheet 5. The belt cleaning device 28 cleans the outer peripheral surface of the intermediate transfer belt 21 by removing the adhering substances such as the toner and paper dust remaining on the outer peripheral surface of the intermediate transfer belt 21 after passing through the secondary transfer device 27.

As the intermediate transfer belt 21, an endless belt made of a material in which a resistance adjusting agent such as carbon black is dispersed in a synthetic resin such as a polyimide resin or a polyamide resin is used. The belt supporting roller 22 is a driving roller that is rotationally driven by a driving device (not illustrated). The belt supporting rollers 23 and 24 are face-up rollers that form an image formation surface of the intermediate transfer belt 21. The belt supporting roller 25 is a tension applying roller that applies tension to the intermediate transfer belt 21. The belt supporting roller 26 is a back surface supporting roller for secondary transfer. The belt supporting roller 22 also serves as an opposing roller opposing the belt cleaning device 28.

The secondary transfer device 27 is a contact type transfer device including a secondary transfer roller. The secondary transfer roller rotates in contact with the peripheral surface of the intermediate transfer belt 21 at the secondary transfer position that is an outer peripheral surface part of the intermediate transfer belt 21 supported by the belt supporting roller 26 in the intermediate transfer device 20. A secondary transfer voltage is supplied to the secondary transfer roller. As the secondary transfer voltage, a DC voltage having a polarity opposite to or the same as the charging polarity of the toner is supplied from a power supply device (not illustrated) to the secondary transfer device 27 or the belt supporting roller 26 of the intermediate transfer device 20.

As illustrated in FIG. 1, the fixing device 40 includes, in a device housing 43 (see FIG. 3), a roller-shaped or belt-shaped heating rotary body 41 and a roller-shaped or belt-shaped pressurizing rotary body 42. The device housing 43 serves as a device body and has an inlet port and an outlet port for the recording sheet 5. The heating rotary body 41 rotates in a direction indicated by an arrow C. The heating rotary body 41 is heated by a heater such that a surface temperature thereof is maintained at a predetermined temperature. The pressurizing rotary body 42 is in contact with the heating rotary body 41 at a predetermined pressure and is driven to rotate in a state of extending substantially along an axial direction of the heating rotary body 41. In the fixing device 40, a contact portion where the heating rotary body 41 and the pressurizing rotary body 42 are in contact with each other serves as a fixing nip portion N where predetermined fixing processing (specifically, heating and pressurizing) is performed. The fixing device 40 integrally includes a decurling device 60. The decurling device 60 corrects curl of the recording sheet 5 subjected to the fixing processing by the heating rotary body 41 and the pressurizing rotary body 42. The configuration of the fixing device 40 will be described in detail later.

The sheet feeding device 30 is disposed at a position below the intermediate transfer device 20. The sheet feeding device 30 includes one or more sheet accommodating bodies 31 and delivery devices 32. The accommodating body 31 accommodates the recording sheets 5 of a desired size, type, and the like in a stacked state. The delivery device 32 delivers the recording sheets 5 one after one from the sheet accommodating body 31. The sheet accommodating body 31 is attached such that the sheet accommodating body 31 is configured to be pulled out to, for example, a front surface (in FIG. 1, a front side in the Y direction) of the apparatus body 1*a* that is a side surface that faces a user during operation.

Examples of the recording sheet 5 include thin sheets (such as plain sheets and tracing sheets), thick sheets, and OHP sheets for use in electrophotographic copiers and printers. To further improve the smoothness of the image surface after fixing, the surface of the recording sheet 5 may be as smooth as possible. For example, so-called thick sheets having a relatively large basis weight such as coated sheets obtained by coating the surfaces of plain sheets with a resin or the like, art sheets for printing, and the like may be used.

One or more pairs of sheet transport rollers 33 and 34 and a sheet feeding transport path 35 are disposed between the sheet feeding device 30 and the secondary transfer device 27. The pairs of sheet transport rollers 33 and 34 transport the recording sheet 5 delivered from the sheet feeding device 30 to the secondary transfer position. The sheet feeding transport path 35 includes a transport guide (not illustrated). The pair of sheet transport rollers 34 are disposed immediately before the secondary transfer position in the sheet feeding transport path 35. The sheet transport rollers 34 are, for example, rollers (registration rollers) that adjust a timing of transporting the recording sheet 5. A sheet transport path 37 is provided between the secondary transfer device 27 and the fixing device 40. The sheet transport path 37 includes a transport belt 36. The transport belt 36 transports the recording sheet 5 subjected to the secondary transfer and sent out from the secondary transfer device 27, to the fixing device 40. Further, an outlet transport path 39 is provided in a part close to a sheet outlet port of the apparatus body 1*a*. The outlet transport path 39 includes a pair of sheet outlet rollers 38 that discharges the fixed recording sheet 5 sent out from the fixing device 40 to a sheet outlet unit (not illustrated) provided on a side surface of the apparatus body 1*a*.

In the image forming apparatus 1 having the above configuration, the sheet feeding transport path 35 including the sheet transport roller pairs 33 and 34, the secondary transfer device 27, the sheet transport path 37 including the transport belt 36, and the fixing device 40 are integrally attached to constitute a sheet transport unit 300. The sheet transport unit 300 is configured to be drawn out to the front surface side with respect to the apparatus body 1*a* of the image forming apparatus 1 via a guide rail (not illustrated).

In the image forming apparatus 1, when a transport failure of the recording sheet 5 occurs in the sheet feeding transport path 35 including the pairs of sheet transport rollers 33 and 34, the secondary transfer device 27, the sheet transport path 37 including the transport belt 36, the fixing device 40, or the like, an operation of pulling out the sheet transport unit 300 from the apparatus body 1*a* to the front is performed.

In the image forming apparatus 1, when the sheet transport unit 300 is pulled out to the front, the sheet feeding transport path 35 including the pairs of sheet transport rollers 33 and 34, the secondary transfer device 27, the sheet transport path 37 including the transport belt 36, the fixing device 40, and the like are exposed to the outside, and the recording sheet 5 in which the transport failure has occurred can be removed.

In FIG. 1, a reference numeral 100 denotes a control device that comprehensively controls the operation of the image forming apparatus 1. The control device 100 includes a central processing unit (CPU), a read only memory (ROM), a random access memory (RAM), a bus that connects the CPU and the ROM, a communication interface, and the like, which are not illustrated.

Operation of Image Forming Apparatus

Hereinafter, a basic image forming operation performed by the image forming apparatus 1 will be described.

Here, an operation in a full-color mode for forming a full-color image that is a combination of toner images of four colors (Y, M, C, K) using the four image forming devices 10(Y, M, C, K) will be described.

When the image forming apparatus 1 receives instruction information on a request for a full-color image forming operation (printing) from a user interface, a printer driver, or the like (not illustrated), the four image forming devices 10(Y, M, C, K), the intermediate transfer device 20, the secondary transfer device 27, the fixing device 40, and the like start operation.

In each of the image forming devices 10(Y, M, C, K), as illustrated in FIGS. 1 and 2, first, the photoconductor drum 11 rotates in the direction indicated by the arrow A. The charging device 12 charges the surface of the photoconductor drum 11 to a required polarity (negative polarity in the first exemplary embodiment) and a required potential Subsequently, the exposure device 13 irradiates the charged surface of the photoconductor drum 11 with light emitted based on an image signal obtained by converting image information input to the image forming apparatus 1 into color components (Y, M, C, K), and forms an electrostatic latent image of each color component having a required potential difference on the surface of the photoconductor drum 11.

Subsequently, each of the image forming devices 10(Y, M, C, K) supplies a toner of a corresponding one of the colors (Y, M, C, K) charged to a required polarity (negative polarity) from the developing roller 141, and causes the toner to electrostatically adhere to the electrostatic latent image of the color component formed on the photoconductor drum thereby performing development. By this development, the electrostatic latent images of the color components formed on the photoconductor drums 11 are visualized as toner images of the four colors (Y, M, C, K) developed with the toners of the corresponding colors.

Subsequently, when the toner images of the respective colors formed on the photoconductor drums 11 of the image forming devices 10(Y, M, C, K) are transported to the primary transfer positions, the primary transfer devices 15(Y, M, C, K) primarily transfer the toner images of the respective colors to the intermediate transfer belt 21 of the intermediate transfer device 20 rotating in the direction indicated by the arrow B such that the toner images of the respective colors are sequentially superimposed on each other.

In each of the image forming devices 10(Y, M, C, K) that has completed the primary transfer, the drum cleaning device 16 clean the surface of the photoconductor drum 11 by scraping off and removing the adhering substances. As a result, each of the image forming devices 10(Y, M, C, K) is ready to perform the next imaging operation.

Subsequently, the intermediate transfer device 20 carries and transports the toner images primarily transferred to the secondary transfer position as the intermediate transfer belt 21 rotates. Meanwhile, the sheet feeding device 30 feeds the required recording sheet 5 to the sheet feeding transport path 35 in accordance with the image forming operation. In the sheet feeding transport path 35, the pair of sheet transport rollers 34 (serving as the registration roller) feeds and supplies the recording sheet 5 to the secondary transfer position in accordance with a transfer timing.

At the secondary transfer position, the secondary transfer device 27 collectively secondarily transfers the toner images on the intermediate transfer belt 21 onto the recording sheet 5. In the intermediate transfer device 20 in which the secondary transfer has been completed, the belt cleaning device 28 cleans the front surface of the intermediate transfer belt 21 after the secondary transfer by removing the adhering substances such as the toner remaining on the surface of the intermediate transfer belt 21.

Subsequently, the recording sheet 5 onto which the toner images have been secondarily transferred is separated from the intermediate transfer belt 21 and then transported to the fixing device 40 via the sheet transport path 37. In the fixing device 40, the recording sheet 5 after the secondary transfer is introduced into and passes through the fixing nip portion N between the rotating heating rotary body 41 and the rotating pressurizing rotary body 42. Accordingly, necessary fixing processing (heating and pressurizing) is performed to fix unfixed toner images onto the recording sheet 5, and the decurling device 60 corrects curl of the recording sheet 5 generated by the fixing processing. Finally, the recording sheet 5 after the fixing is discharged to the sheet discharge unit (not illustrated) provided on the side surface of the apparatus body 1*a* by the pair of sheet outlet rollers 38.

By the above operation, the recording sheet 5 on which the full-color image which is the combination of the toner images of the four colors is formed is output.

Configuration of Fixing Device

Figure 3:
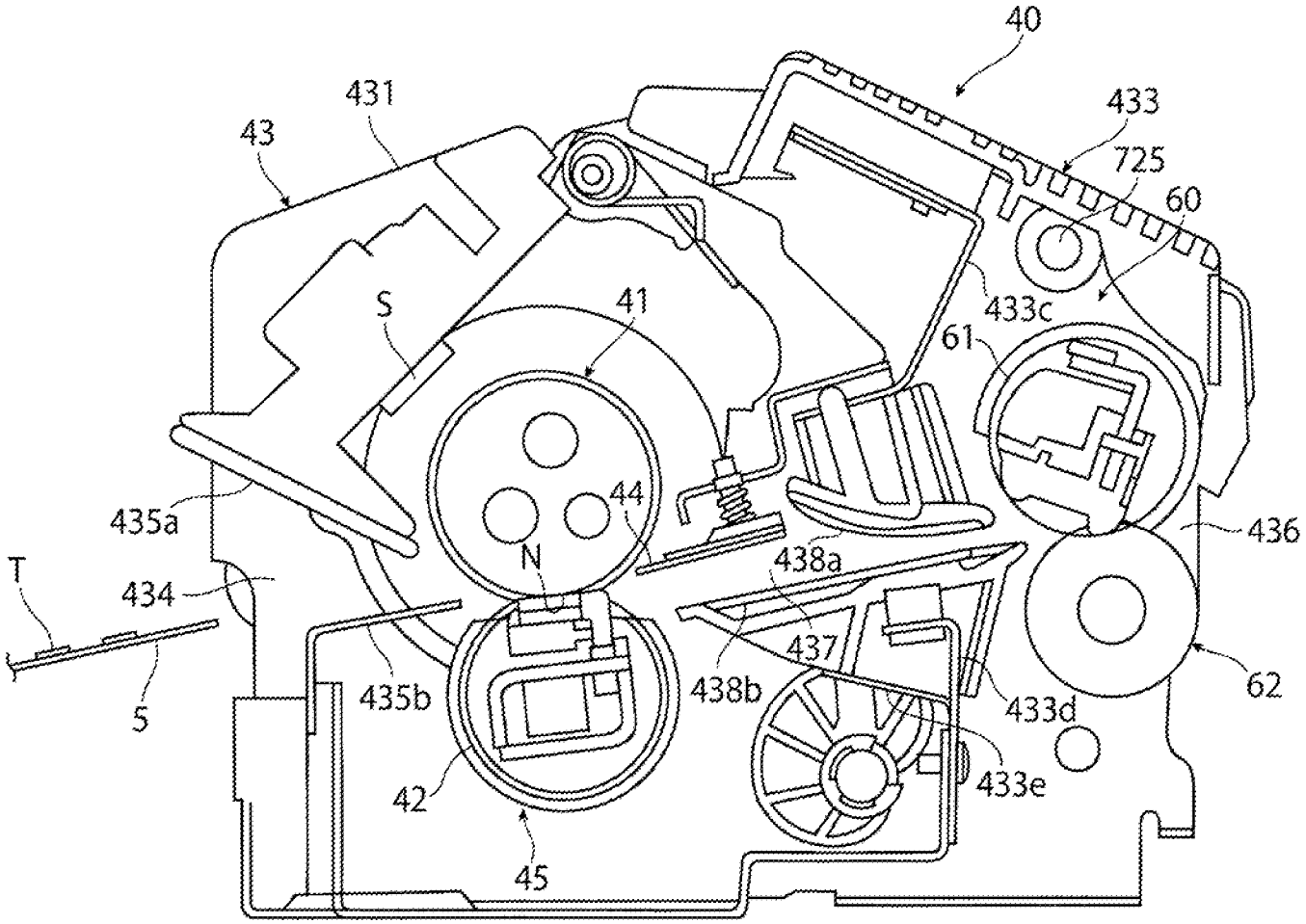
FIG. 3 is a cross-sectional view illustrating a fixing device to which the decurling device according to the first exemplary embodiment of the present disclosure is applied.

FIG. 3 is a cross-sectional view illustrating the fixing device to which the decurling device according to the first exemplary embodiment is applied. The fixing device 40 integrally includes the decurling device (decurler) 60.

As illustrated in FIG. 3, the fixing device 40 includes a device housing 43, a heating roller 41, a pressurizing belt 42, a peeling claw 44, a decurling belt 61, and a decurling roller 62. The device housing 43 is an example of a device body of the fixing device 40. The heating roller 41 and the pressurizing belt 42 are provided inside the device housing 43. The heating roller 41, which is the heating rotary body, and the pressurizing belt 42, which is the pressurizing rotary body, are an example of a fixing unit. The heating roller 41 and the pressurizing belt 42 perform the fixing processing on the recording sheet 5. The peeling claw 44 is integrally provided inside the device housing 43. The peeling claw 44 is an example of a peeling assisting unit that assists peeling of the recording sheet 5 from the heating roller 41. The decurling belt 61 and the decurling roller 62 are integrally provided inside the device housing 43. The decurling belt 61, which is an example of an endless belt (correction belt), and the decurling roller 62, which is an example of a rotary body, correct curl of the recording sheet 5 by sandwiching the recording sheet 5 therebetween.

The heating rotary body is not limited to the heating roller 41. An endless belt may be used as the heating rotary body. The pressurizing rotary body is not limited to the pressurizing belt 42. A roller-shaped rotary body may be used as the pressurizing rotary body.

Figure 4:
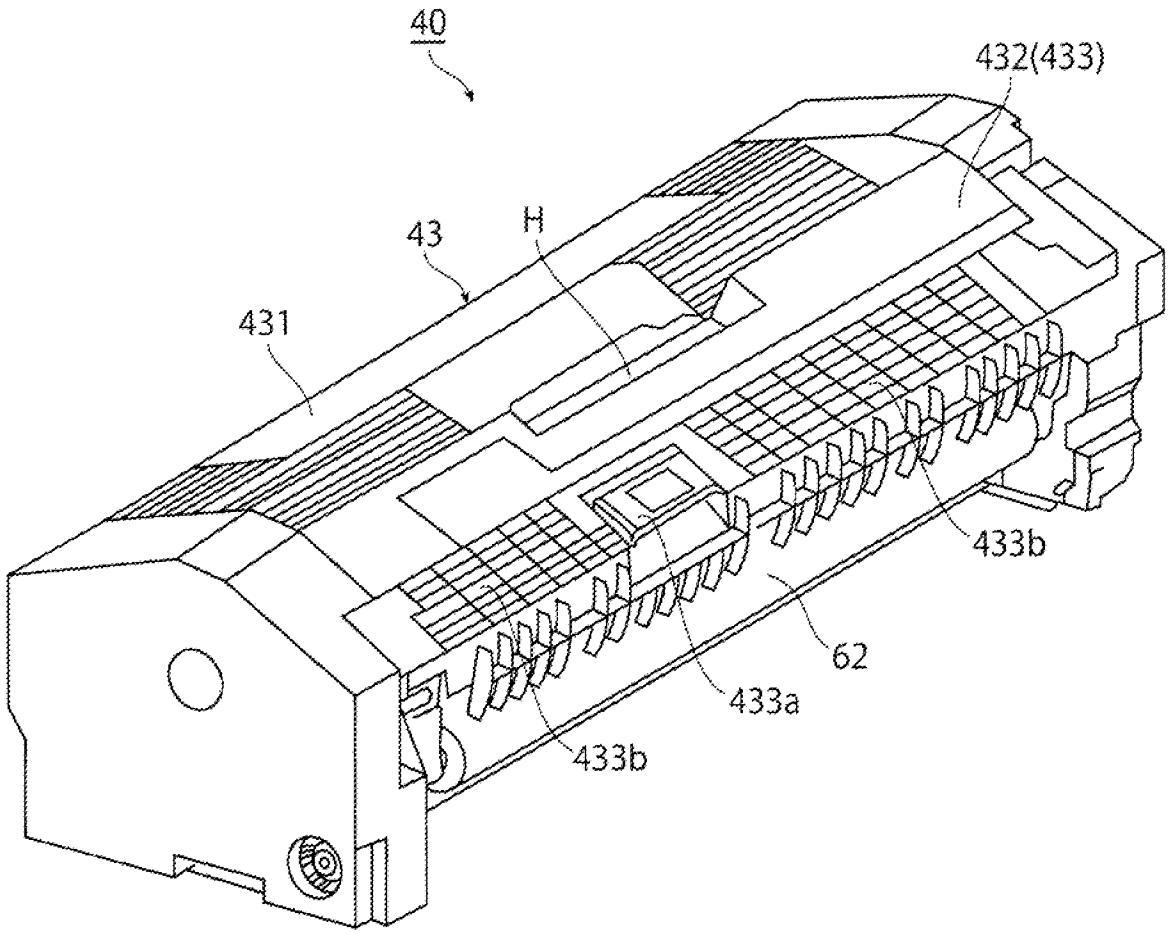
FIG. 4 is a perspective view illustrating a device housing of the fixing device to which the decurling device according to the first exemplary embodiment of the present disclosure is applied.

As illustrated in FIG. 4, the device housing 43 is formed in an elongated box shape having a substantially pentagonal side surface. The device housing 43 includes plural frames made of a sheet metal or the like and an exterior member made of a synthetic resin or the like. The exterior member covers outer peripheries of the plural frames.

The device housing 43 includes, on an upper end surface thereof, a first inclined surface portion 431 and a second inclined surface portion 432. The first inclined surface portion 431 is disposed upstream in the transport direction of the recording sheet 5. The first inclined surface portion 431 is inclined with a downstream end portion in the transport direction of the recording sheet 5 being located on an upper side in the vertical direction. The second inclined surface portion 432 is disposed downstream in the transport direction of the recording sheet 5. The second inclined surface portion 432 is inclined with a downstream end portion in the transport direction of the recording sheet 5 being located on a lower side in the vertical direction. The second inclined surface portion 432 of the device housing 43 constitutes an opening and closing cover 433 that is an example of an opening and closing unit. The opening and closing cover 433 is openable and closable with respect to the device housing 43. An operation handle 433*a* is rotatably attached to the opening and closing cover 433 via a rotation shaft 725 on a front side in the longitudinal direction. The operation handle 433*a* is operated when opening and closing the opening and closing cover 433. The rotation shaft 725 will be described later. The opening and closing cover 433 is provided with a grid-patterned exhaust port 433*b* that exhausts upward air sent from below as necessary in order to cool the decurling device 60. A reference sign "H" denotes a grip portion provided at a center of the upper end surface of the device housing 43. The operator grips the fixing device 40 using the grip portion.

As illustrated in FIG. 3, the device housing 43 has an inlet port 434 on a left side surface thereof. The recording sheet 5 having unfixed toner images T transferred thereto is introduced into the device housing 43 through the inlet port 434. An upper guide 435*a* and a lower guide 435*b* are disposed inside the inlet port 434 and guide the recording sheet 5 to the fixing nip portion N where the heating roller 41 and the pressurizing belt 42 are in pressure contact with each other. The device housing 43 has an outlet port 436 on the right side surface thereof. The recording sheet 5 whose curl has been corrected by the decurling belt 61 and the decurling roller 62 is discharged to the outside through the outlet port 436. Inside the device housing 43, a transport path 437 of the recording sheet 5 is formed. The transport path 437 is inclined such that a downstream side of the transport path 437 in the transport direction of the recording sheet 5 from the inlet port 434 toward the outlet port 436 is located on an upper side in the vertical direction. Inside the device housing 43, an upper chute 438*a* and a lower chute 438*b* are disposed between (i) the heating roller 41 and the pressurizing belt 42 and (ii) the decurling belt 61 and the decurling roller 62. The upper chute 438*a* and the lower chute 438*b* guide both a front surface and a back surface of the recording sheet 5. The upper chute 438*a* is attached to the opening and closing cover 433 via an attachment frame 433*c* fixed to the inner surface of the opening and closing cover 433 so as to be openable and closable together with the opening and closing cover 433. The lower chute 438*h* is attached via attachment frames 433*d* and 433*e* fixed to the inside of the device housing 43. The recording sheet 5 is transported using, as a reference, a center in a direction extending along the front surface that is the width direction intersecting the transport direction (so-called center registration). In FIG. 3, a reference sign "S" denotes a non-contact temperature sensor that detects the surface temperature of the heating roller 41.

Figure 5:
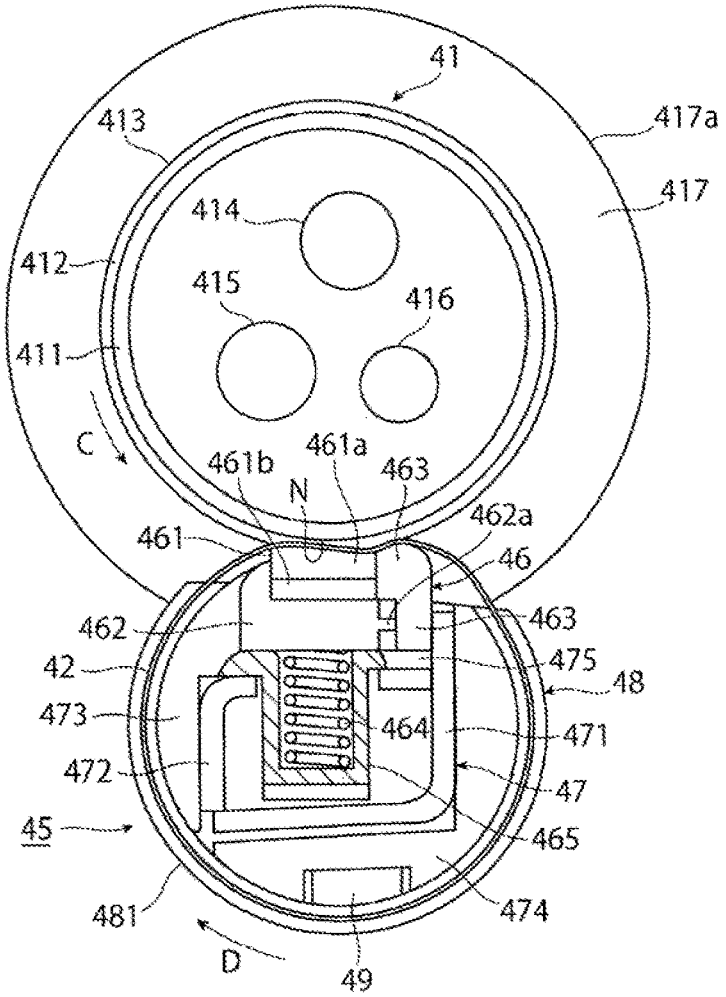
FIG. 5 is a cross-sectional view illustrating a part of the fixing device according to the first exemplary embodiment of the present disclosure.

As illustrated in FIG. 5, the heating roller 41 includes a cylindrical core 411, an elastic body layer 412, and a release layer 413. The cylindrical core 411 is made of a metal such as stainless steel, aluminum, or iron (thin high-tensile steel pipe). The elastic body layer 412 covers an outer periphery of the core 411. The elastic body layer 412 made of a heat resistant elastic body such as silicone rubber or fluororubber. The release layer 413 is thinly coated on the front surface of elastic body layer 412. The release layer 413 is made of perfluoroalkoxy alkane (PFA), polytetrafluoroethylene (PTFE), or the like. Plural halogen lamps 414 to 416 (three halogen lamps in the illustrated example) are disposed inside the heating roller 41. The halogen lamps 414 to 416 are an example of a heating source. The three halogen lamps 414 to 416 are turned on individually or in group simultaneously according to the size and type of the recording sheet 5. Both end portions of the core 411 of the heating roller 41 in the axial direction are rotatably supported via a bearing 417 (an example of a bearing member) attached to a frame of the device housing 43. The bearing 417 has an outer peripheral surface 417*a* formed in a cylindrical shape. The outer peripheral surface 417*a* is formed of an outer cylinder made of a metal such as stainless steel.

The heating roller 41 is rotationally driven at a required speed in the direction of the arrow C by a driving device (not illustrated) via a driving gear. The driving gear is not illustrated, and includes a helical gear or the like attached to an end portion of the core 411 on a back surface side in the axial direction. Plural rotation speeds of the heating roller 41 may be set according to the type of the recording sheet 5 or the like.

As illustrated in FIG. 3, the peeling claw 44 is disposed on the outer peripheral surface of the heating roller 41. The peeling claw 44 prevents the recording sheet 5 from winding around the outer peripheral surface of the heating roller 41 and assists peeling of the recording sheet 5 from the surface of the heating roller 41. At the exit of the fixing nip portion N, the tip of the peeling claw 44 faces the surface of the heating roller 41 with a predetermined minute gap therebetween. The peeling claw 44 is inclined at a required angle relative to the outer peripheral surface of the heating roller 41. The peeling claw 44 is formed of an elongated rectangular thin metal plate or the like disposed over substantially an entire length in the axial direction of the heating roller 41.

As illustrated in FIG. 3, the pressurizing belt 42 constitutes a pressurizing unit 45 integrally assembled to hold the pressurizing belt 42 and bring the pressurizing belt 42 into pressure contact with the heating roller 41.

As illustrated in FIG. 5, the pressurizing unit 45 includes the pressurizing belt 42, a pressurizing member 46 (an example of a pressurizing unit), a support member 47 (an example of a support unit), a guide member 48 (an example of a guide unit), and a felt 49 (an example of a lubricant holding unit). The pressurizing member 46 is disposed inside the pressure belt 42 and brings the pressure belt 42 into pressure contact with the surface of the heating roller 41. The support member 47 is disposed inside the pressurizing belt 42 and supports the pressurizing member 46. The guide member 48 rotatably guides both end portions of the pressurizing belt 42 in the longitudinal direction. The felt 49 is disposed inside the pressurizing belt 42 and holds a lubricant applied to the inner peripheral surface of the pressurizing belt 42.

Figure 6:
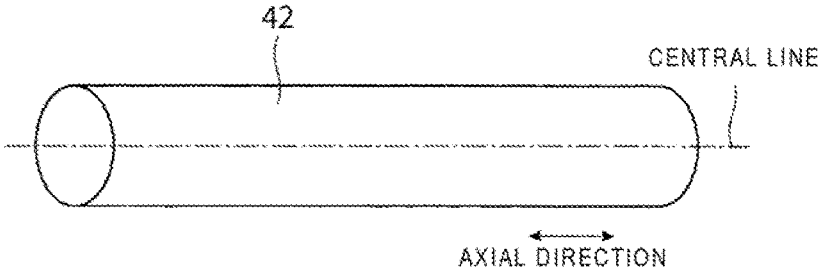
FIG. 6 is a perspective view illustrating a pressurizing belt.
Figure 7:
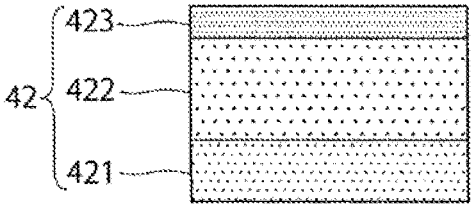
FIG. 7 is a cross-sectional view illustrating the pressurizing belt.

As illustrated in FIG. 6, the pressurizing belt 42 is made of a material having flexibility and is an endless belt. The pressurizing belt 42 before attached to the pressurizing unit 45 has a thin cylindrical shape. As illustrated in FIG. 7, the pressurizing belt 42 includes a base material layer 421, an elastic body layer 422 covering a front surface of the base material layer 421, and a release layer 423 covering a front surface of the elastic body layer 422. The pressurizing belt 42 may include the base material layer 421 and the release layer 423 covering the front surface of the base layer 421. The base material layer 421 is formed of a heat resistant synthetic resin such as polyimide, polyamide, or polyimide-eamide. The elastic body layer 422 is made of a heat resistant elastic body such as silicone rubber or fluororubber. The release layer 423 is made of perfluoroalkoxy alkane (PFA), polytetrafluoroethylene (PTFE), or the like. The pressurizing belt 42 may have a thickness of, for example, about 50 μm or more and about 200 μm or less.

The pressurizing belt 42 is driven to rotate in a direction of an arrow D by being brought into pressure contact with the heating roller 41.

As illustrated in FIG. 5, the pressurizing member 46 is a member that brings the pressurizing belt 42 into pressure contact with the heating roller 41. The pressurizing member 46 includes a pad member 461, a pad support member 462, and a pressurizing member 463. The pad member 461 comes into contact with the inner peripheral surface of the pressurizing belt 42 to bring the pressurizing belt 42 into pressure contact with the heating roller 41. The pad support member 462 supports the pad member 461. The pressurizing member 463 presses the pressurizing belt 42 toward the heating roller 41 at the exit portion of the fixing nip portion N, deforms the elastic body layer 412 of the heating roller 41 into a concave shape, and separates the recording sheet 5 from the surface of the heating roller 41 by the rigidity of the recording sheet 5 itself.

The pad member 461 includes a first pad member 461*a* and a second pad member 461*b*. The first pad member 461*a* includes a foam body made of silicone rubber or acrylonitrile rubber that forms the fixing nip portion N. The first pad member 461*a* has a substantially rectangular shape in cross section. The second pad member 461*b* includes a metal pedestal that supports the first pad member 461*a*. The first pad member 461*a* is fixed to the second pad member 461*b* by adhesion or the like.

The pad support member 462 includes a heat resistant synthetic resin or the like and has a substantially L-shape in cross section. The pad support member 462 has a projection portion 462*a* that holds the pressing member 463 on a downstream end surface thereof in the rotational direction of the pressurizing belt 42. The pad support member 462 is elastically supported by plural (for example, ten) coil springs 464 arranged in the longitudinal direction of the pressurizing belt 42. The coil spring 464 is supported by a support cylinder 465 attached to the support member 47.

The pressing member 463 is made of a heat resistant synthetic resin or the like and has a substantially reverse L-shape in cross section. The pressing member 463 is supported by a short flat plate-shaped support plate 475 in a state where the pressing member 463 is held between the projection portion 462*a* of the pad support member 462 and the support member 47. A lower end portion of the support plate 475 is fixed to the support member 47 by welding, crimping, or the like.

As illustrated in FIG. 5, the support member 47 is a member that supports the pressurizing member 46, which is brought into pressure contact with the heating roller 41 via the pressurizing belt 42. The configuration of the support member 47 is not limited to the above example. The support member 47 has any configuration if the support member 47 has rigidity capable of reacting against a reaction force from the heating roller 41. The support member 47 according to the first exemplary embodiment includes first and second support members 471 and 472 that are two sheet metals having a substantially L-shape in cross section. The first and second support member 471 and 472 are combined and fixed so as to have a substantially rectangular shape in a cross section. Both end portions 471*a* and 472*a* of the first and second support members 471 and 472 in the longitudinal direction thereof are fitted to the guide member 48 to be fixed (see FIG. 9). Holding members 473 and 474 that rotatably hold the inner peripheral surface of the pressurizing belt 42 are attached to the first and second support members 471 and 472. The support cylinder 465 that supports the coil springs 464 is provided integrally with the holding member 473, for example.

The guide members 48 are disposed at both end portions, in the axial direction, of the pressurizing belt 42. The guide member 48 is integrally formed of a heat-resistant synthetic resin or the like. As illustrated in FIG. 5, the guide member 48 includes a flange portion 481, a guide portion (not illustrated), attachment portions 482 (see FIG. 8), and a fixing portion 483 (see FIG. 9). The flange portion 481 is formed in a substantially plate shape and has an outer diameter larger than an outer diameter of the pressurizing belt 42. The guide portion is formed in a short cylindrical shape on an inner side surface of the flange portion 481 and rotatably guides an end portion of the pressurizing belt 42. The attachment portions 482 protrude from left and right sides of the flange portion 481, respectively. The fixing portion 483 has a substantially rectangular side surface on an outer side surface of the flange portion 481.

Figure 8:
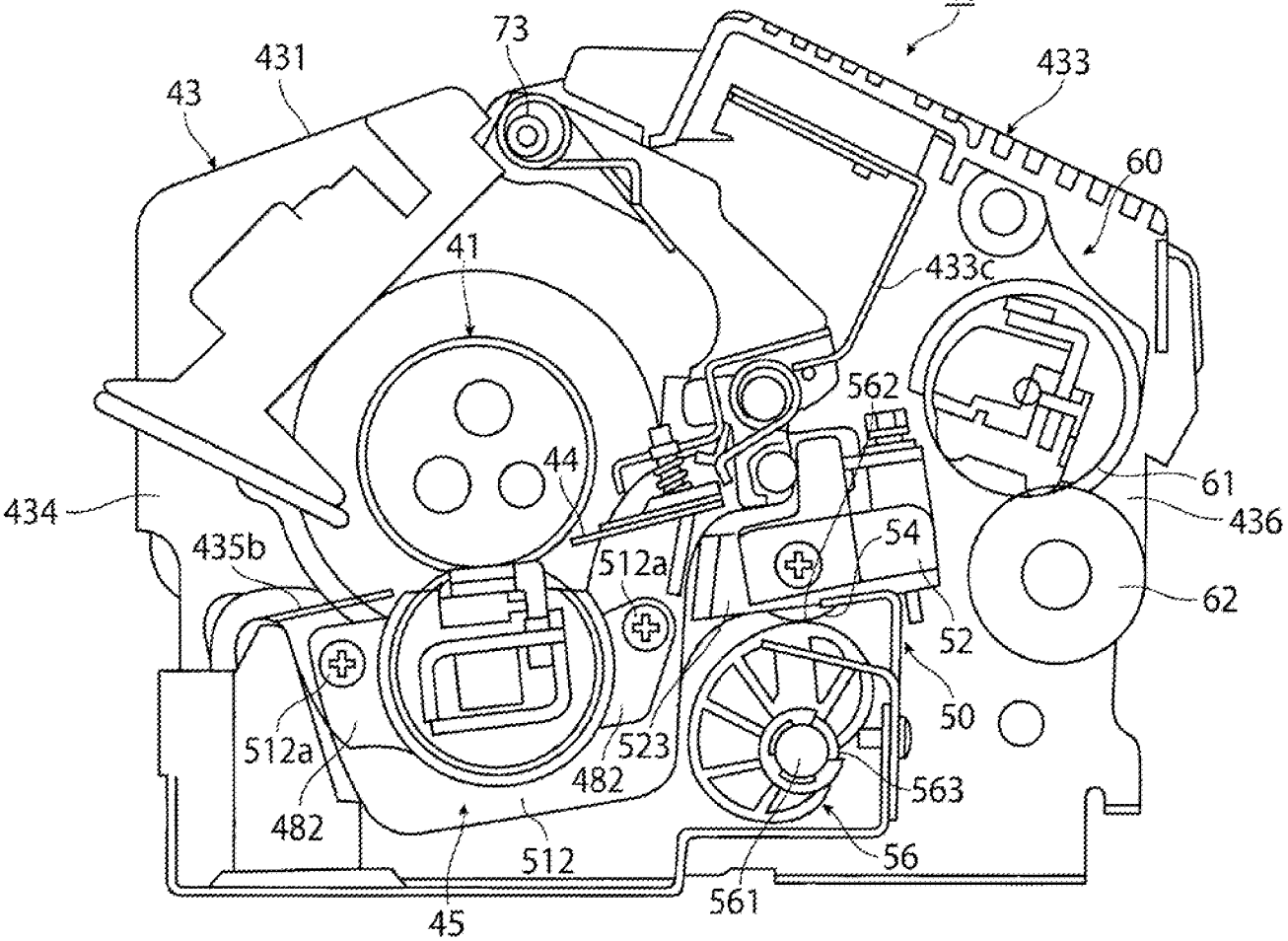
FIG. 8 is a cross-sectional view illustrating the fixing device.
Figure 9:
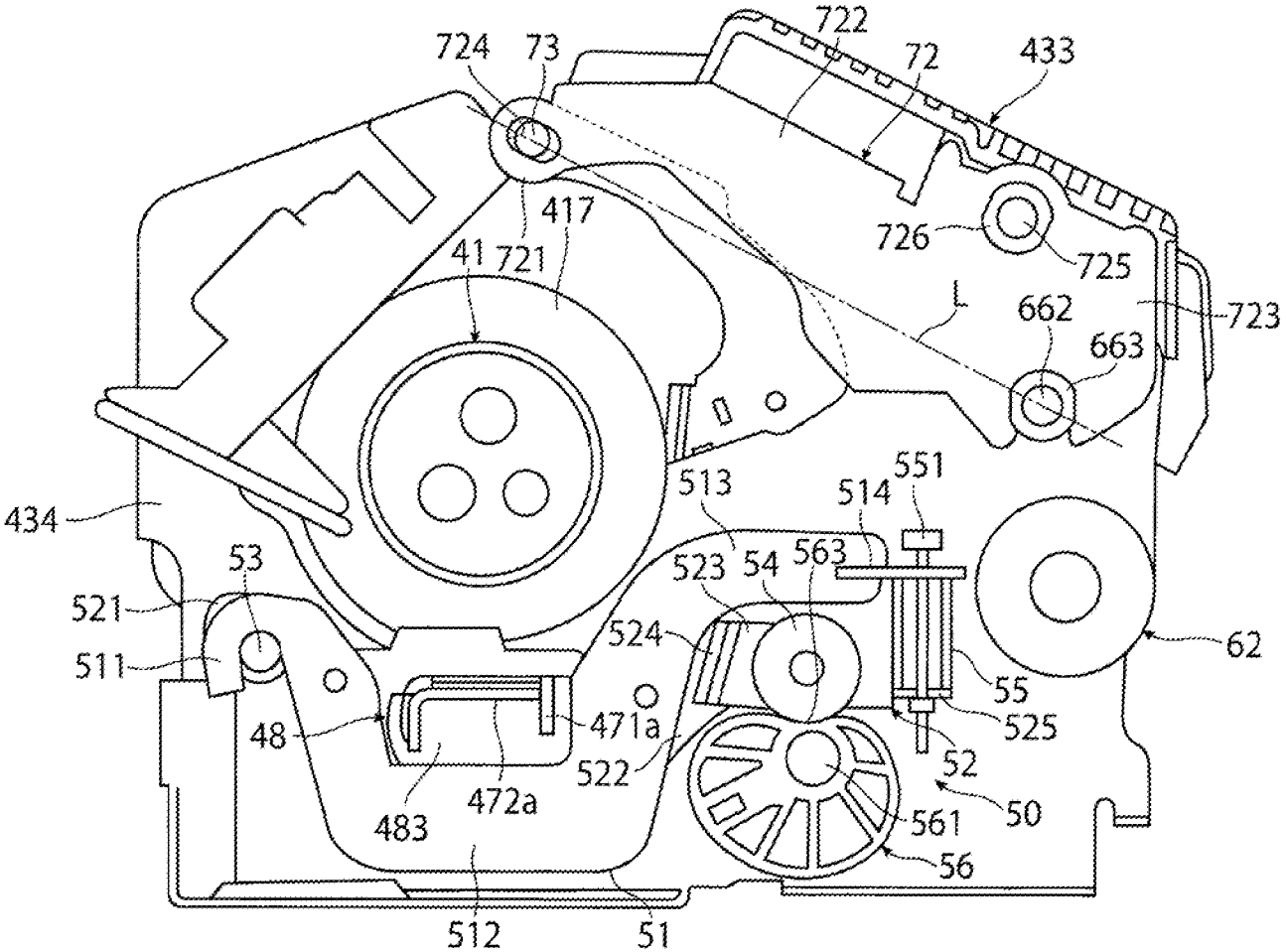
FIG. 9 is a cross-sectional view illustrating the fixing device.

As illustrated in FIGS. 8 and 9, the attachment portions 482 of the guide member 48 are fixed to a pressurizing arm 51 with screws 512*a* in a state where the fixing portion 483 having the rectangular side surface is fixed to an intermediate portion 512 of the pressurizing arm 51.

As illustrated in FIG. 5, the felt 49 is formed in an elongated rectangular shape in a cross section over the substantially entire length of the pressurizing belt 42. The felt 49 is provided in a recess portion on the lower end surface of the holding member 474 by adhesion or the like. The felt 49 is impregnated with a predetermined amount of lubricant to be supplied in a state of being applied to the inner peripheral surface of the pressurizing belt 42. The lubricant reduces a sliding resistance between the pressurizing belt 42 and the pressurizing member 46. As the lubricant, for example, an amino-modified silicone oil having a viscosity of 100 cs or more and 350 cs or less is used. The felt 49 is impregnated with the lubricant in advance, and the lubricant is applied and supplied to the inner peripheral surface of the pressurizing belt 42. It is noted that the present disclosure is not limited thereto. Alternatively, the lubricant may be supplied in a state of being applied to the inner peripheral surface of the pressurizing belt 42 initially.

As illustrated in FIGS. 8 and 9, the pressurizing unit 45 is movable in a direction in which the pressure unit 45 comes into contact with or separates from the heating roller 41 by a retraction mechanism 50 (an example of a contact and separation unit). The retraction mechanism 50 includes the pressurizing arms 51 and action arms 52. The pressurizing arms 51 are rotatable about a support shaft 53 (an example of a fulcrum). The pressurizing unit 45 is attached to the pressurizing arms 51. The action arms 52 are also rotatable about the support shaft 53 and apply a pressing force to the pressurizing arms 51. The pressurizing arms 51 are disposed at both end portions of the pressurizing belt 42 in the axial direction. The action arms 52 are disposed on the inner side of the pressurizing arms 51 in the axial direction of the pressurizing belt 42 to be adjacent to the pressurizing arms 51, respectively.

The pressurizing arm 51 includes a flat plate shaped sheet metal or the like having a required thickness. The pressurizing arm 51 includes a base end portion 511, the intermediate portion 512, and a tip portion 513. The base end portion 511 has a substantially inverted U-shape. At the inlet port 434 of the device housing 43, the base end portion 511 is rotatably supported by the support shaft 53 disposed at a base end portion of the lower guide member 435*b*. A side surface of the intermediate portion 512 is formed in a substantially U shape. The intermediate portion 512 holds the pressurizing unit 45. The tip portion 513 extends in a substantially horizontal direction from a right upper end portion of the intermediate portion 512.

As illustrated in FIG. 8, the right and left attachment portions 482 of the guide member 48 constituting the pressurizing unit 45 are fixed to the intermediate portion 512 of the pressurizing arm 51 with the screws 512*a*. When the pressurizing unit 45 moves upward together with the pressurizing arms 51, the pressurizing belt 42 is pressed against the surface of the heating roller 41 with a required pressing force via the support member 47 and the pressurizing member 46.

The action arm 52 is formed in a shape substantially similar to that of the pressurizing arm 51. The action arm 52 includes a base end portion 521, an intermediate portion 522, and a tip portion 523. The base end portion 521 is rotatably supported by the support shaft 53. A side surface of the intermediate portion 522 is formed in a substantially U shape. The tip portion 523 extends in the substantially horizontal direction from a right upper end portion of the intermediate portion 522.

As illustrated in FIG. 9, the tip portion 523 of the action arm 52 is located below the tip portion 513 of the pressurizing arm 51 via a bent portion 524. The tip portion 523 of the action arm 52 is bifurcated to be parallel to the tip portion 513 of the pressurizing arm 51. A disk-shaped cam follower 54 is rotatably attached between the bifurcated tip portions 523 of the action arm 52.

A pressurizing spring 55 is interposed between the tip portion 513 of the pressurizing arm 51 and the tip portion 523 of the action arm 52. The pressurizing spring 55 applies a pressing force to the pressurizing arm 51. A support plate 514 is provided at the tip portion 513 of the pressurizing arm 51 by welding or the like. The support plate 514 supports an upper end portion of the pressurizing spring 55. A support plate portion 525 is bent in a substantially U-shape in a cross section so as to be integrally provided at the tip portion 523 of the action arm 52. The support plate portion 525 supports a lower end portion of the pressurizing spring 55. An adjustment bolt 551 is attached between the support plate 514 of the pressurizing arm 51 and the support plate portion 525 of the action arm 52. The adjustment bolt 551 adjusts the pressing force of the pressurizing spring 55.

A first eccentric cam 56 is rotatably disposed below the cam follower 54 of the action arm 52. A rotation shaft 561 can rotate the first eccentric cam 56. The first eccentric cam 56 includes a pressurizing portion 562 having the largest radius and a pressurizing release portion 563 having the smallest radius. The first eccentric cam 56 has an eccentric substantially oval shape which is formed by connecting the pressurizing portion 562 and the pressurizing releasing portion 563 with a smooth curved surface. The rotation shaft 561 of the first eccentric cam 56 is rotationally driven in a clockwise direction and a counterclockwise direction by a driving motor (not illustrated) disposed on the back surface side of the device housing 43, so that the pressurizing belt 42 is brought into pressure contact with the heating roller 41 with a required pressing force, and the pressurizing belt 42 may be switched to a pressure contact released state (see FIG. 9) in which the pressurizing belt 42 is separated from the heating roller 41. When the pressurizing release portion 563 of the first eccentric cam 56 rotates to a position where the pressurizing release portion 563 faces the cam follower 54, the pressurizing arm 51 retracts to a lower pressurizing released position by its own weight together with the action arm 52. At the pressurizing released position, a pressurizing state between the pressurizing belt 42 and the heating roller 41 may only have to be released, and the pressure belt 42 may not be separated from the surface of the heating roller 41.

The fixing device 40 having the above configuration fixes the unfixed toner images T onto the recording sheet 5 passing through the fixing nip portion N by heating and pressurizing the recording sheet 5 with the heating roller 41 and the pressurizing belt 42. When the recording sheet 5 on which the unfixed toner images T are to be fixed passes through the fixing nip portion N, the recording sheet 5 is curved due to various factors such as a material of the recording sheet 5, an area of the unfixed toner images T to be fixed on the recording sheet 5, and a thickness of a toner layer. In the fixing device 40, for example, when the recording sheet 5 such as a thick sheet passes through the fixing nip portion N, the recording sheet 5 may be curved in a downward convex shape. In the fixing device 40, for example, when the recording sheet 5 such as a plain sheet or a thin sheet such as tracing sheet passes through the fixing nip portion N, the recording sheet 5 may be curved in an upward convex shape.

Configuration of Decurling Device

Figure 10:
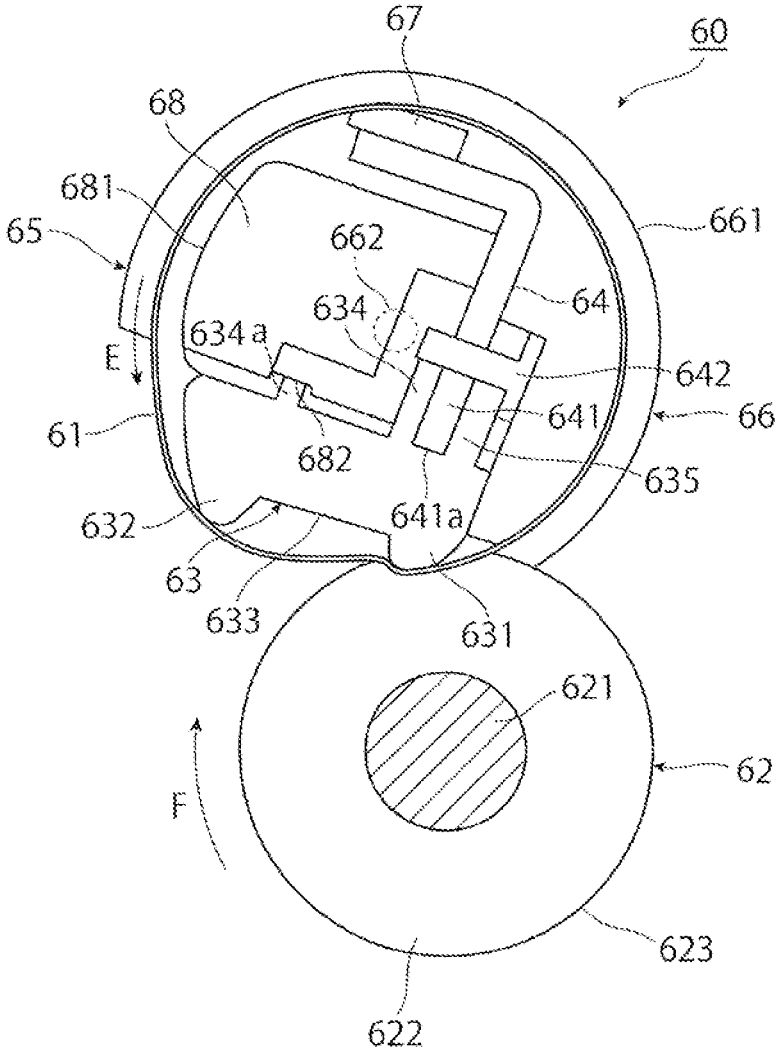
FIG. 10 is a cross-sectional view illustrating the decurling device according to the first exemplary embodiment of the present disclosure.

As illustrated in FIG. 10, the decurling device 60 includes a decurling belt 61 (an example of a correction belt) and a decurling roller 62 (an example of a rotary body). The decurling belt 61 comes into contact with a front surface of the recording sheet 5 (that is, a surface of the recording medium 5 on which the toner image has been formed) to correct curl of the recording sheet 5. The decurling roller 62 comes into contact with a back surface of the recording sheet 5 to correct the curl of the recording sheet 5. The decurling device 60 corrects the curl of the recording sheet 5 using the decurling belt 61 and the decurling roller 62 in both cases where the recording sheet 5 is curved in a direction in which the recording sheet 5 is convex downward and where the recording sheet 5 is curved in a direction in which the recording sheet 5 is convex upward. The decurling belt 61 and the decurling roller 62 are a pair of decurling units.

The decurling belt 61 is an endless belt that corrects curl of the recording sheet 5 by passing the recording sheet 5 between the decurling belt 61 and the decurling roller 62. A pressure contact member 63 (an example of a pressure contact unit) is disposed inside the decurling belt 61. An opposite surface of the pressure contact member 63 to the decurling roller 62 is supported by a support frame 64 (an example of a support unit) having rigidity. The pressure contact member 63 is in pressure contact with the decurling roller 62.

The decurling belt 61 constitutes a correction belt unit 65 including the pressure contact member 63, the support frame 64, and the like disposed inside the decurling belt 61. The correction belt unit 65 includes the decurling belt 61, the pressure contact member 63, the support frame 64, a pair of guide members 66 (an example of a guide unit), a felt 67 (an example of a lubricant holding unit), and a holding member 68 (an example of a holding unit). The pressure contact member 63 is disposed inside the decurling belt 61. The pressure contact member 63 brings the decurling belt 61 into pressure contact with the surface of the decurling roller 62. The support frame 64 supports the pressure contact member 63. The pair of guide members 66 rotatably guides both end portions of the decurling belt 61 in a longitudinal direction of the decurling belt 61. The felt 67 is disposed inside the decurling belt 61. The felt 67 holds the lubricant to be applied to an inner peripheral surface of the decurling belt 61. The holding member 68 rotatably holds the inner peripheral surface of the decurling belt 61.

Figure 11:
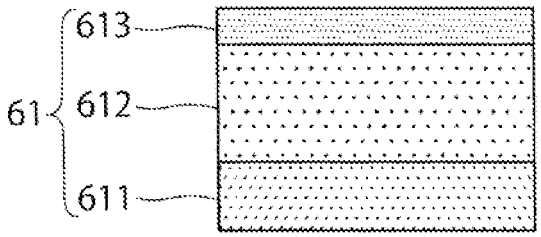
FIG. 11 is a cross-sectional view illustrating a decurling belt.

Similarly to the pressurizing belt 42 described above, the decurling belt 61 is made of a material having flexibility and is an endless belt. The decurling belt 61 has a thin cylindrical shape before attached to the decurling device 60. As illustrated in FIG. 11, the decurling belt 61 includes a base material layer 611, an elastic body layer 612 covering a surface of the base material layer 611, and a release layer 613 covering a surface of the elastic body layer 612. The decurling belt 61 may include the base material layer 611 and the release layer 613 covering the surface of the base material layer 611. The base material layer 611 is made of a heat resistant synthetic resin, such as polyimide, polyamide, or polyimideamide. The elastic body layer 612 is made of a heat resistant elastic body such as silicone rubber or fluororubber. The release layer 613 is made of perfluoroalkoxy alkane (PFA), polytetrafluoroethylene (PTFE), or the like. The decurling belt 61 may have a thickness of, for example, about 50 μm or more and about 200 μm or less.

The decurling belt 61 is brought into pressure contact with the decurling roller 62 to be driven to rotate in a direction indicated by an arrow E.

As illustrated in FIG. 10, the pressure contact member 63 is formed in a thick flat plate shape and is made of a heat resistant synthetic resin or the like. The pressure contact member 63 includes, on a lower end surface thereof, a first protruding portion 631 (an example of a first pressure contact portion), a second protruding portion 632 (an example of a second pressure contact portion), and a flat surface portion 633. The first protruding portion 631 is disposed downstream in the transport direction of the recording sheet 5 and has a downward curved mountain shape. The second protruding portion 632 is disposed upstream in the transport direction of the recording sheet 5 and has a downward curved mountain shape. The flat surface portion 633 is flat and disposed between the first protruding portion 631 and the second protruding portion 632. An amount by which the second protruding portion 632 protrudes is equal to or larger than that by which the first protruding portion 631 protrudes.

The pressure contact member 63 has, on a back surface thereof, a pair of attachment plate portions 634 and 635 standing upward. The support frame 64 is attached to the back surface of the pressure contact member 63 by the pair of attachment plate portions 634 and 635 with fixed to a downstream end portion of the pressure contact member 63 in the transport direction of the recording sheet 5.

The support frame 64 includes a sheet metal or the like having a required thickness and bent into a substantially L-shape in a cross section. A lower end portion 641 of the support frame 64 constitutes a contact portion at which a lower end surface 641*a* thereof is in contact with (abuts on) the back surface of the pressure contact member 63. The lower end portion 641 is fixed with a screw 642 in a state of being sandwiched between the attachment plate portions 634 and 635 of the pressure contact member 63.

The guide members 66 are attached with fixed to both end portions of the support frame 64 in the longitudinal direction. The guide member 66 is integrally formed of a heat-resistant synthetic resin or the like. As illustrated in FIG. 10, the guide member 66 includes a flange portion 661, a guide portion (not illustrated), and a rotation shaft 662. The flange portion 661 is formed in a substantially disk shape and has an outer diameter larger than an outer diameter of the decurling belt 61. The guide portion is formed in a short cylindrical shape on an inner side surface of the flange portion 661. The guide portion rotatably guides an end portion of the decurling belt 61. The rotation shaft 662 includes a columnar metal embedded in the center of an outer side surface of the flange portion 661 to protrude outward.

As illustrated in FIG. 9, in the correction belt unit 65, the rotation shaft 662 of the guide member 66 is rotatably attached to a support arm 72 via a bearing member 663.

The support arm 72 is attached with fixed to inner side surfaces of both end portions of the opening and closing cover 433 in the longitudinal direction. The opening and closing cover 433 is opened and closed around a support shaft 73 via the support arm 72.

As illustrated in FIG. 9, the support arm 72 includes a sheet metal or the like having a required thickness. The support arm 72 includes a base end portion 721, an intermediate portion 722, and a substantially rectangular tip portion 723. The base end portion 721 is rotatably supported by the support shaft 73. The intermediate portion 722 extends horizontally from the base end portion 721 and then bent obliquely downward. The tip portion 723 is provided on a side of the intermediate portion 722. The base end portion 721 of the support arm 72 is rotatably supported by the support shaft 73 via an elongated hole 724. The elongated hole 724 elongates in the major axis direction along a straight line L connecting the support shaft 73 and the rotation shaft 662 of the decurling belt 61. The elongated hole 724 is formed in an elliptical shape and has an opening width corresponding to the outer diameter of the support shaft 73 in a minor axis direction intersecting the major axis direction thereof. Therefore, the support arm 72 is attached to the support shaft 73 in a manner of being positioned in the minor axis direction while being movable in the major axis direction of the elongated hole 724.

A rotation shaft 725 is rotatably provided in the tip portion 723 of the support arm 72 via a bearing member 726. The operation handle 433*a* of the opening and closing cover 433 is rotatably attached to an upper end portion of the rotation shaft 725. As described above, the bearing member 663 that rotatably supports the rotation shaft 662 of the decurling belt 61 is attached to a lower end portion of the tip portion 723 of the support arm 72.

Figure 14:
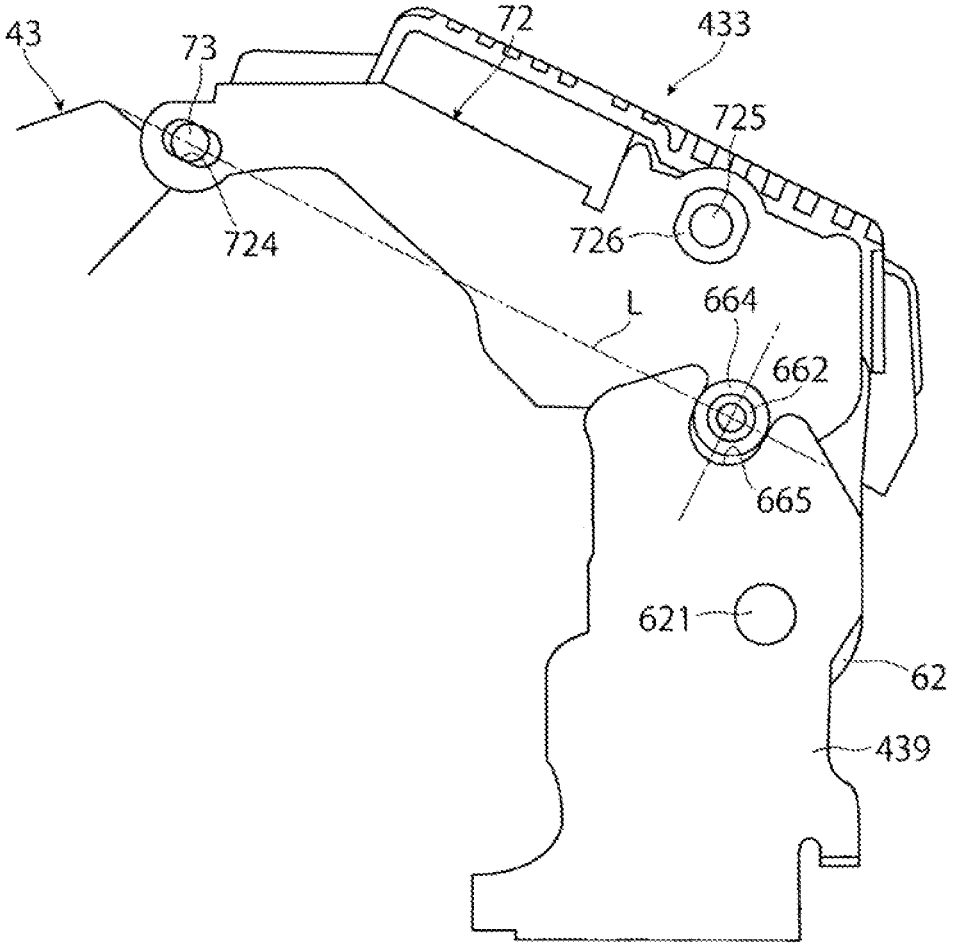
FIG. 14 is a cross-sectional view illustrating a of a positioning structure of a support arm of the fixing device according to the first exemplary embodiment of the present disclosure.

As illustrated in FIG. 14, a positioning roller 664 is rotatably provided on the rotation shaft 662 of the decurling belt 61. When the opening and closing cover 433 is closed, the positioning roller 664 is fitted into positioning portions 665 formed of recessed grooves in auxiliary frames 439 provided inside the device housing 43, so that the support arm 72 is positioned. The recessed groove constituting the positioning portion 665 is formed in a substantially U-shape along a direction intersecting with the straight line L connecting the support shaft 73 and the rotation shaft 662 of the decurling belt 61. Therefore, when the positioning roller 664 is fitted to the positioning portion 665, the rotation shaft 662 of the decurling belt 61 is positioned in the direction extending along the straight line L connecting the support shaft 73 and the rotation shaft 662 of the decurling belt 61. The position of the rotation shaft 662 of the decurling belt 61 in the direction intersecting the straight line L is determined by the minor axis direction of the elongated hole 724 provided in the base end portion 721 of the support arm 72.

Figure 12:
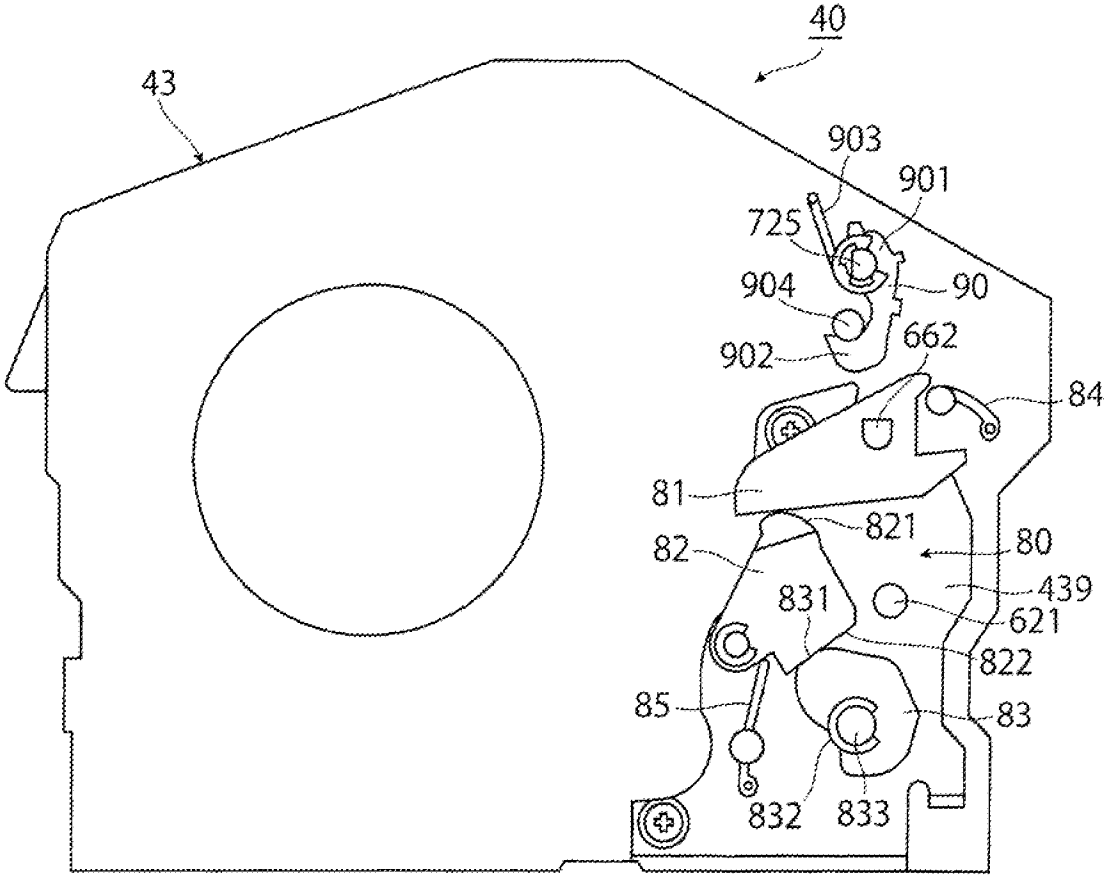
FIG. 12 is a side view illustrating a switching mechanism of the decurling device.

As illustrated in FIG. 12, the opening and closing cover 433 is provided with a stopper member 90 (an example of a release unit). The stopper member 90 holds the opening and closing cover 433 in a closed state and releases the pressure contact between the decurling belt 61 and the decurling roller 62 by opening the opening and closing cover 433. The stopper member 90 includes a base end portion 901 fixed to the rotation shaft 725 and a tip portion 902 having a substantially J-shaped side surface. The stopper member 90 is biased in the clockwise direction by a coil spring 903 wound around the rotation shaft 725. The tip portion 902 of the stopper member 90 is engaged with an engagement pin 904 provided on a frame of the device housing 43. When the tip portion 902 of the stopper member 90 is engaged with the engagement pin 904, the opening and closing cover 433 is positioned in the closed state.

As described above, the operation handle 433*a* (see FIG. 4) for opening and closing the opening and closing cover 433 is attached and fixed to the rotation shaft 725. The opening and closing cover 433 is biased in an opening direction by a spring (not illustrated). Therefore, when the opening and closing cover 433 is closed, the opening and closing cover 433 is stopped in a state where the tip portion 902 of the stopper member 90 is engaged with the engagement pin 904 of the device housing 43.

As illustrated in FIG. 10, the felt 67 is formed in an elongated rectangular shape in a cross section over substantially the entire length of the decurling belt 61. The felt 67 is provided on an upper end surface of the support frame 64 by adhesion or the like. The felt 67 is impregnated with a predetermined amount of lubricant to be supplied in a state of being applied to the inner peripheral surface of the decurling belt 61. The lubricant reduces a sliding resistance between the decurling belt 61 and the pressure contact member 63. As the lubricant, for example, an amino-modified silicone oil having a viscosity of 100 cs or more and 350 cs or less is used. The felt 67 is impregnated with the lubricant in advance, and the lubricant is applied and supplied to the inner peripheral surface of the decurling belt 61. It is noted that the present disclosure is not limited thereto. Alternatively, the lubricant may be supplied in a state of being applied to the inner peripheral surface of the decurling belt 61 initially.

The holding member 68 is made of a heat resistant synthetic resin or the like. One side surface 681 of the holding member 68 is formed in an arc shape along the inner peripheral surface of the decurling belt 61. Both end portions of the holding member 68 in the longitudinal direction are attached to the guide members 66. A recess portion 682 is provided on the lower end surface of the holding member 68. The recess portion 682 abuts against a projection portion 634*a* provided on the upper end surface of the pressure contact member 63.

Figure 13:
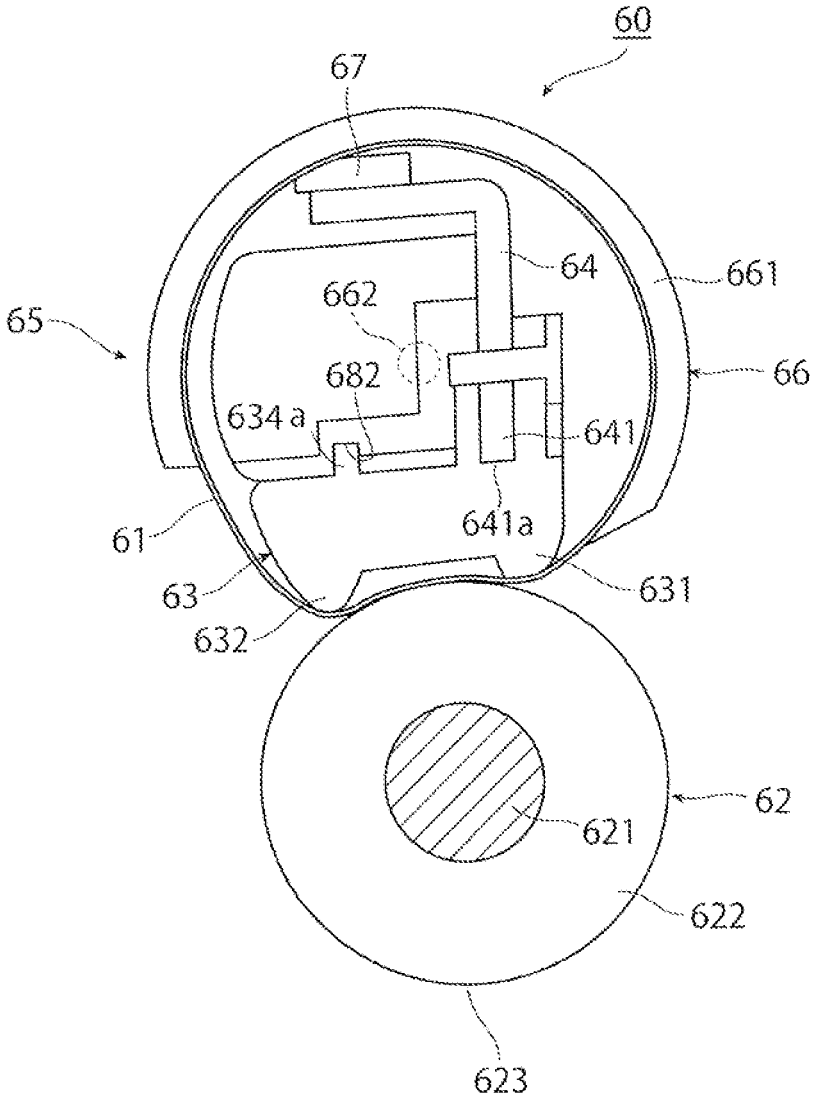
FIG. 13 is a cross-sectional view illustrating a second position of the decurling device.

As illustrated in FIG. 12, the correction belt unit 65 can switch a pressure contact state with respect to the decurling roller 62 by being rotated about the rotation shaft 662 by a switching mechanism 80 (an example of a switching unit). Swing arms 81 are attached and fixed to both end portions of the correction belt unit 65 in the axial direction of the rotation shaft 662. The end portions of the correction belt unit 65 have substantially D-shaped side surfaces. By rotating the correction belt unit 65 about the rotation shaft 662, the correction belt unit 65 can be switched between a first position (first state) and a second position (second state). In the first position, the first protruding portion 631 of the pressure contact member 63 penetrates into the surface of the decurling roller 62 with a relatively large pressure contact force as illustrated in FIG. 10. In the second position, both the first and second protruding portions 631 and 632 of the pressure contact member 63 come into contact with the surface of the decurling roller 62 with a relatively small pressure contact force via the decurling belt 61 or face the surface of the decurling roller 62 via a gap as illustrated in FIG. 13.

When the correction belt unit 65 is rotated to the first position, the first protruding portion 631 is brought into pressure contact with the surface of the decurling roller 62 so as to penetrate into the surface of the decurling roller 62 with the relatively large pressure contact force via the decurling belt 61, and corrects the recording sheet 5 that is curved in the upward convex shape and passes between the decurling belt 61 and the decurling roller 62 into a planar shape.

When the correction belt unit 65 is rotated to the second position, the first and second protruding portions 631 and 632 come into contact with the surface of the decurling roller 62 with the relatively small pressure contact force via the decurling belt 61, and corrects the recording sheet 5 that is curved in the downward convex shape and passes between the decurling belt 61 and the decurling roller 62 into a planar shape.

As illustrated in FIG. 12, the switching mechanism 80 includes the swing arm 81, an intermediate cam 82, and a second eccentric cam 83. The swing arm 81 has a substantially triangular side surface and is attached and fixed to an end portion of the rotation shaft 662 of the guide member 66 in the correction belt unit 65. The intermediate cam 82 abuts against a tip portion of the swing arm 81 to rotate the swing arm 81. The second eccentric cam 83 rotates the intermediate cam 82. The swing arm 81 is fixed to the rotation shaft 662 of the guide member 66 in the vicinity of a base end portion formed in a substantially triangular shape on a side surface. The swing arm 81 is biased by a spring 84 to rotate in the counterclockwise direction. The intermediate cam 82 is formed in a substantially trapezoidal shape on a side surface. The intermediate cam 82 has a curved portion 821 that comes into contact with the swing arm 81 and a straight portion 822 that comes into contact with the second eccentric cam 83. The intermediate cam 82 is biased by a spring 85 to rotate in the clockwise direction and come into contact with the second eccentric cam 83. The second eccentric cam 83 is formed in a substantially oval shape. The second eccentric cam 83 has a first pressurizing portion 831 having the largest radius and a second pressure contact portion 832 having the smallest radius. The first pressurizing portion 831 and the second pressure contact portion 832 are connected by a smooth curved surface. A rotation shaft 833 of the second eccentric cam 83 is rotationally driven by a driving motor (not illustrated) disposed on a front surface side of the device housing 43. Therefore, the second eccentric cam 83 switches between a first position where the decurling belt 61 is brought into pressure contact with the decurling roller 62 and a second position where the decurling belt 61 is brought into contact with the decurling roller 62 with a weak force.

As illustrated in FIG. 10, the decurling roller 62 includes a metal core 621, an elastic body layer 622, and a release layer 623. The metal core 621 is formed in a columnar shape. The elastic body layer 622 is made of a foamed or non-foamed elastic body or the like that is relatively thickly coated on an outer peripheral surface of the core 621. The release layer 623 is coated on a surface of the elastic body layer 622. The core 621 of the decurling roller 62 is rotatably attached to the frame of the device housing 43. The decurling roller 62 is rotationally driven in a direction indicated by an arrow F by a driving device (not illustrated) disposed in front of the device housing 43. As illustrated in FIG. 14, both end portions of the core 621 of the decurling roller 62 in the axial direction thereof are rotatably attached to the auxiliary frames 439, respectively. The auxiliary frames 439 are disposed at both end portions of the device housing 43 in the longitudinal direction thereof.

As illustrated in FIG. 10, in the decurling device 60 having the above configuration, the decurling belt 61 is brought into pressure contact with the surface of the decurling roller 62 by the pressure contact member 63 disposed inside the decurling belt 61. An opposite surface (specifically, an upper end surface) of the pressure contact member 63 to the decurling roller 62 is supported by the support frame 64. The support frame 64 is attached in a state in which both end portions thereof in the longitudinal direction are fixed to the guide members 66. The guide members 66 are rotatably attached to the support arm 72.

Figure 15A:
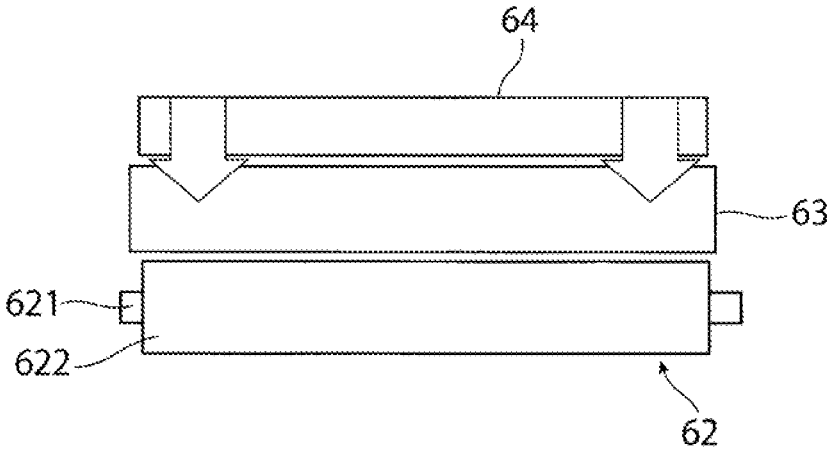
FIGS. 15A and 15B illustrate an effect of a decurling device before the first exemplary embodiment is applied.
Figure 15B:
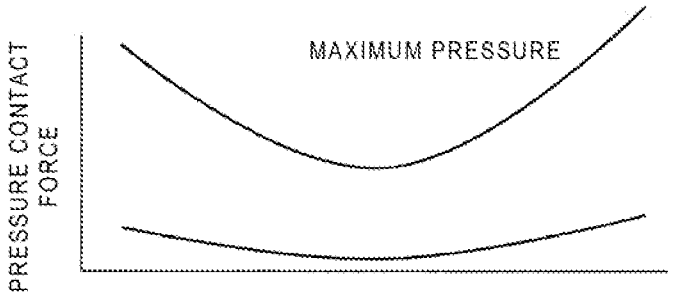

Therefore, in the decurling device 60 before the first exemplary embodiment is applied, as illustrated in FIG. 10, when the correction belt unit 65 is rotated about the rotation shaft 662 and the first protruding portion 631 of the pressure contact member 63 is brought into pressure contact with the surface of the decurling roller 62, the pressure contact member 63 is flexed to be curved along the axial direction of the decurling roller 62. As a result, as illustrated in FIGS. 15A and 15B, the pressure contact force between the decurling belt 61 and the decurling roller 62 is largely reduced in a center portion in the longitudinal direction as compared with both end portions due to a flexural deformation of the pressure contact member 63 and the like. Therefore, the decurling belt 61 and the decurling roller 62 has a technical problem in that the pressure contact force is greatly different between the center portion and both end portions in the longitudinal direction, and wrinkles are generated in the recording sheet 5 or skew is generated in the recording sheet 5 due to a difference in a deformation amount of the elastic body layer 622 of the decurling roller 62.

Figure 16A:
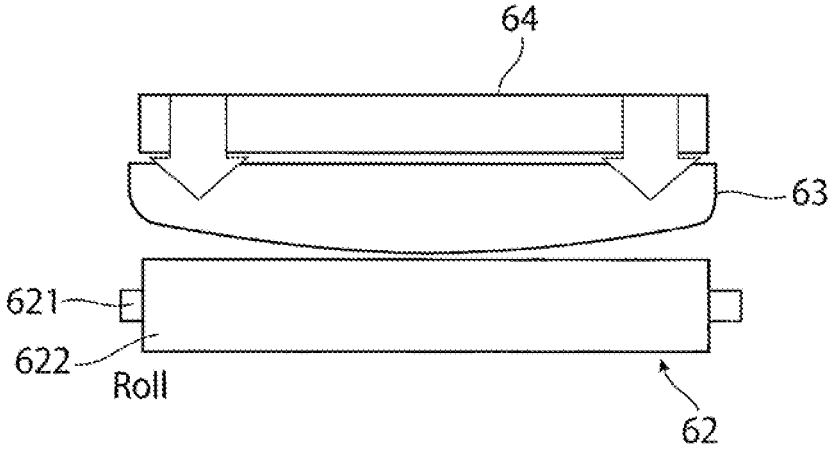
FIGS. 16A and 16B illustrate an effect of the decurling device before the first exemplary embodiment is applied.
Figure 16B:
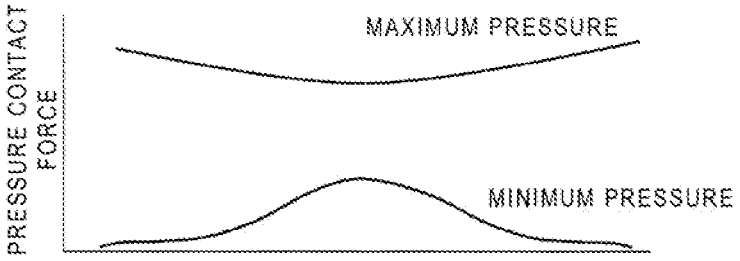

With regard to such a technical problem, as illustrated in FIGS. 16A and 16B, it is conceivable to make the pressure contact force of the pressure contact member 63 to the decurling roller 62 uniform in the axial direction by forming the contact portion of the pressure contact member 63 where the pressure contact member 63 is in pressure contact with the decurling roller 62 into a shape in which a center portion of the contact portion in the axial direction of the decurling roller 62 further protrudes than both end portions of the contact portion.

When the contact portion of the pressure contact member 63 where the pressure contact member 63 is in pressure contact with the decurling roller 62 is formed such that the center portion of the contact portion in the axial direction of the decurling roller 62 further protrudes than both end portions of the contact portion as described above, as illustrated in FIG. 16B, the pressure contact force in the axial direction of the decurling roller 62 can be made substantially uniform when the maximum pressure at the first position is exerted. On the other hand, when the pressure contact member 63 is brought into contact with the surface of the decurling roller 62 with a weak pressure contact force when the minimum pressure at the second position is exerted, the pressure contact force at both end portions of the contact portion in the axial direction of the decurling roller 62 is substantially zero, and another technical problem of decurling failure arises.

Therefore, in the decurling device 60 according to the first exemplary embodiment, a center portion, in the axial direction of the rotary body, of at least one of the contact portion of the pressure contact unit or the contact portion of the support unit further protrudes toward the other of the contact portions than both end portions.

In the decurling device 60 according to the first exemplary embodiment, the contact portion of the pressure contact unit with the support unit protrudes toward the support unit.

In the decurling device 60 according to the first exemplary embodiment, the center portion, in the axial direction of the rotary body, of the contact portion of the pressure contact unit is formed in a linear shape.

Furthermore, in the decurling device 60 according to the first exemplary embodiment, the contact portion of the pressure contact unit with the support unit protrudes stepwise along the axial direction of the rotary body.

Figure 17:
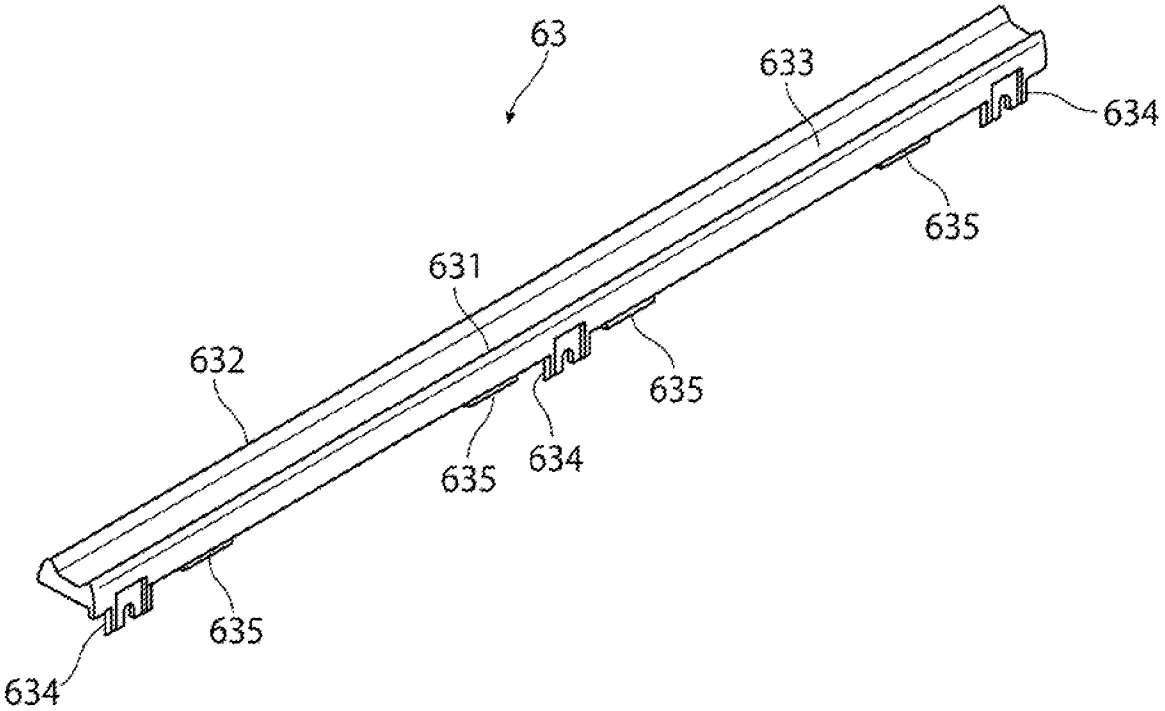
FIG. 17 is a perspective view illustrating a pressure contact member.

That is, in the decurling device 60 according to the first exemplary embodiment, the contact portion between the pressure contact member 63 and the support frame 64 is configured as follows. As illustrated in FIGS. 17 to 18C, plural ribs 636 and 637 are provided on a back surface of the pressure contact member 63 in a lattice shape. The ribs 636 extend along the longitudinal direction of the pressure contact member 63. The ribs 637 extend along a widthwise direction intersecting the longitudinal direction of the pressure contact member 63. With this configuration, the pressure contact member 63 has an increasing rigidity in both the longitudinal direction and the widthwise direction while reducing the weight of the pressure contact member 63.

Figure 19A:
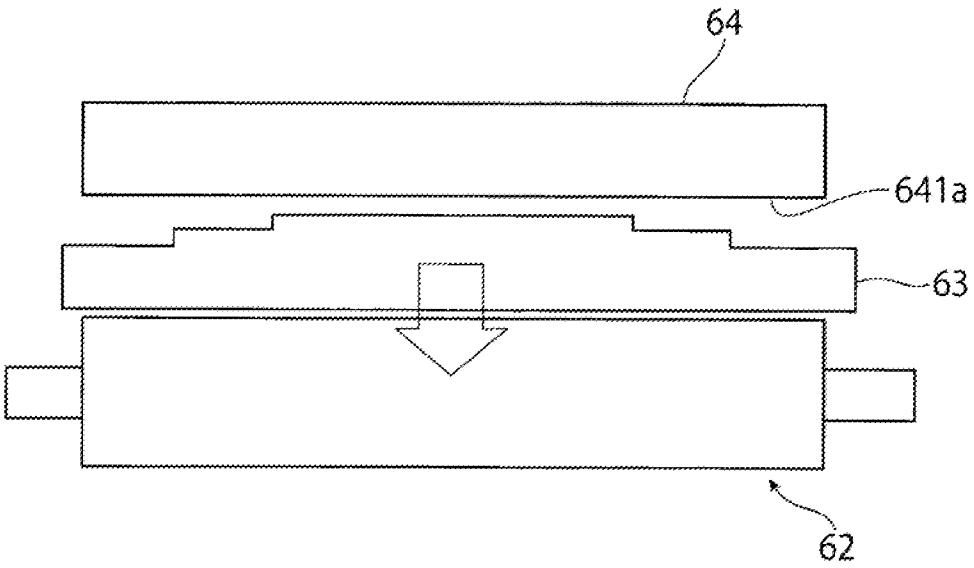
FIGS. 19A and 19B illustrate an effect of the decurling device according to the first exemplary embodiment of the present disclosure.
Figure 19B:
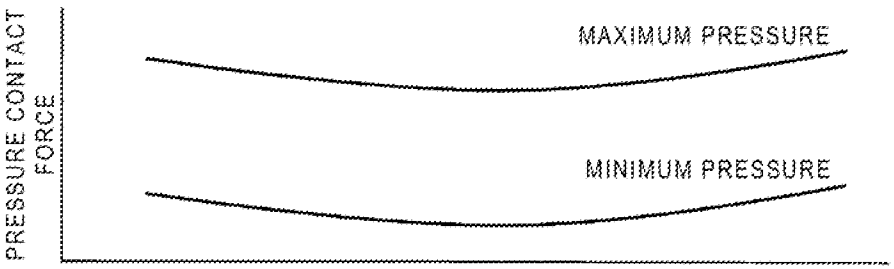

As illustrated in FIGS. 19A and 19B, the support frame 64 is attached in a state where the lower end surface 641*a* of the lower end portion 641 formed in a flat plate shape is abutted against upper end surfaces of the plural ribs 637 disposed along the widthwise direction between the pair of attachment plate portions 634 and 635 of the pressure contact member 63. Therefore, in the support frame 64, the lower end surface 641*a* of the lower end portion 641 that abuts against upper end surfaces 637' of the plural ribs 637 of the pressure contact member 63 serves as a contact portion that supports the pressure contact member 63 while receiving a reaction force of the pressure contact force from the decurling roller 62.

In the first exemplary embodiment, the upper end surfaces 637' of the plural ribs 637 of the pressure contact member 63 are not arranged in a planar shape in a direction intersecting a pressure contact direction, that is, the upper end surfaces 637' of the plural ribs 637 of the pressure contact member 63 do not all have the same height H. As illustrated in FIG. 18B, the heights H of the upper end surfaces 63T of the plural ribs 637 of the pressure contact member 63 are formed in such a manner that a height H1 of the center portion in the axial direction of the decurling roller 62 is larger than a height H3 of the both end portions so that the upper end surfaces 637' of the plural ribs 637 of the pressure contact member 63 have a stepped shape in the axial direction of the decurling roller 62.

More specifically, in the first exemplary embodiment, the upper end surfaces 637' of the plural ribs 637 of the pressure contact member 63 are divided into a first region 630A that is a center portion in the axial direction of the decurling roller 62, second regions 630B that are located on both sides of the first region 630A, and third regions 630C that are located on both end portions and on both sides of the second region 630B.

The upper end surfaces 637' of the plural ribs 637 of the pressure contact member 63 are set in such a manner that the first region 630A protrudes to the largest height, the second regions 630B protrude to the second largest height, and the third regions 630C protrude to the least height. Here, a height difference, which is a difference in height between the plural ribs 636 and 637 in the first to third regions, may be appropriately set in consideration of making the pressure contact force in the axial direction of the decurling roller 62 substantially uniform.

As a result, the upper end surfaces of the plural ribs 636 and 637 of the pressure contact member 63 are formed in the step shape that is bilaterally symmetrical in the axial direction of the decurling roller 62. The upper end surfaces 63T of the plural ribs 637 of the pressure contact member 63 are divided such that the first region 630A located in the center portion occupies approximately ½ of the decurling roller 62 in the axial direction and has the longest straight line shape among the first to third regions 630A to 630C.

The upper end surfaces 637' of the plural ribs 637 of the pressure contact member 63 are not limited to the three regions of the first to third regions 630A to 630C, and may be divided into two regions including a center portion and both end portions, or may be divided into four or more regions. The upper end surfaces 637' of the plural ribs 637 of the pressure contact member 63 do not have to be formed in a bilateral symmetry shape in the axial direction of the decurling roller 62, and may be formed in a bilateral asymmetric shape.

The contact portion of the pressure contact member 63 that comes into contact with the support frame 64 does not have to include the plural ribs 637. The contact portion may include a plane extending along the axial direction of the decurling roller 62. Here, when the contact portion of the pressure contact member 63 that comes into contact with the support frame 64 is formed in a planar shape along the axial direction of the decurling roller 62, the contact portion may be divided into plural regions as described above, and heights of the plural regions may be different from each other.

Effect of Decurling Device

According to the fixing device 40 including the decurling device 60 according to the first exemplary embodiment, in the following manner, in the decurling device including the rotary body and the correction belt that is in pressure contact with the rotary body, the fluctuation of the pressure contact force of the rotary body in the axial direction can be prevented when the pressure contact force between the rotary body and the correction belt is changed.

That is, as illustrated in FIG. 3, the fixing device 40 according to the first exemplary embodiment fixes the unfixed toner images T onto the recording sheet 5, and corrects curl of the recording sheet 5 subjected to the fixing process using the decurling device 60.

According to the decurling device 60, as illustrated in FIG. 10, when the correction belt unit 65 is rotated to the first position, the first protruding portion 631 is brought into pressure contact with the surface of the decurling roller 62 so as to penetrate into the surface of the decurling roller 62 with the relatively large pressure contact force via the decurling belt 61, and corrects the recording sheet 5 that is curved in the upward convex shape and passes between the decurling belt 61 and the decurling roller 62 into the planar shape.

At this time, the first protruding portion 631 of the pressure contact member 63 disposed inside the decurling belt 61 is pressed against the elastic body layer 622 of the decurling roller 62 with a relatively large pressure contact force via the decurling belt 61.

As illustrated in FIG. 13, when the correction belt unit 65 is rotated to the second position, the first and second protruding portions 631 and 632 contact the surface of the decurling roller 62 with the relatively small pressure contact force via the decurling belt 61, and corrects the recording sheet 5 that is curved in the downward convex shape and passes between the decurling belt 61 and the decurling roller 62 into the planar shape.

At the first position, the upper end surface of the pressure contact member 63 comes into contact with the lower end surface 641*a* of the lower end portion 641 of the support frame 64, and the pressure contact member 63 is supported against the reaction force of the pressure contact force from the decurling roller 62.

Figure 18A:
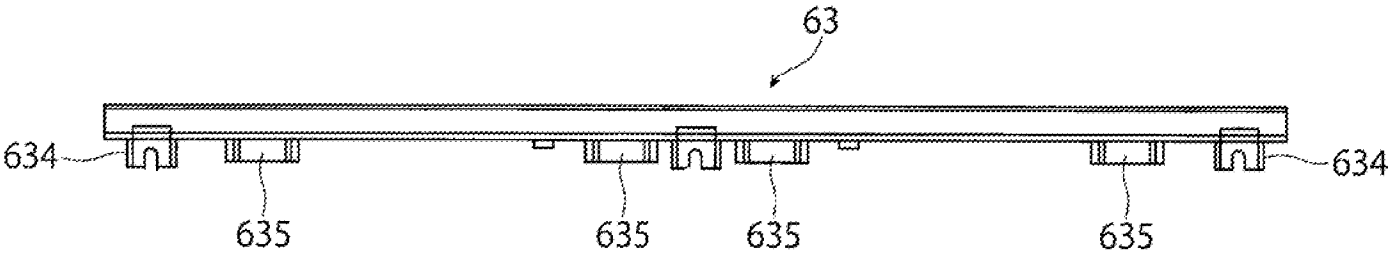
FIGS. 18A to 18C are a front view, a back view, and a cross-sectional view illustrating a part of the pressure contact member.
Figure 18B:
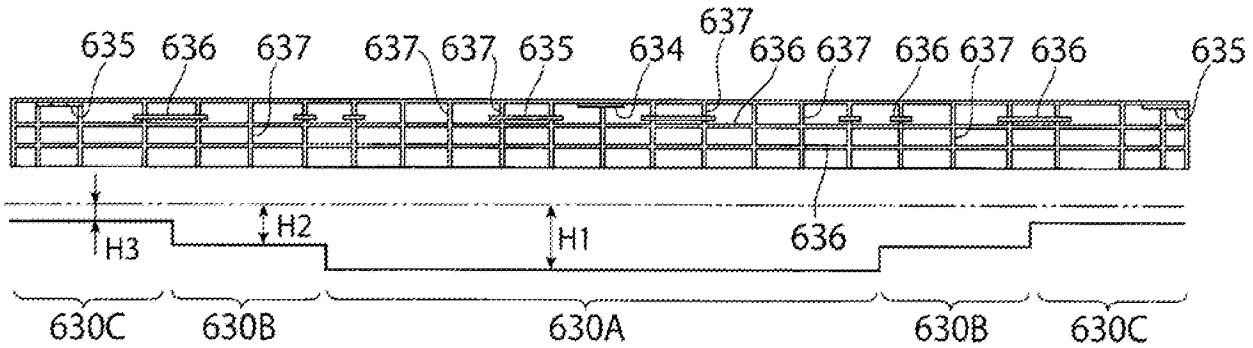
Figure 18C:
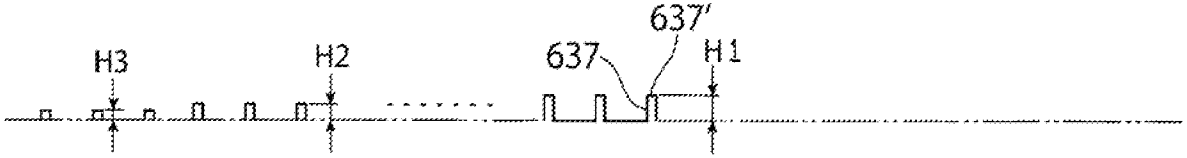

In the decurling device 60 according to the first exemplary embodiment, as illustrated in FIGS. 18A to 18C, the plural ribs 637 formed on the upper end surface of the pressure contact member 63 have different heights H1 to H3 at the center portion and both end portions in the axial direction of the decurling roller 62.

Therefore, in the plural ribs 637 of the pressure contact member 63, the first region 630A protruding with the largest height H1 with respect to the lower end surface 641*a* of the support frame 64 comes into contact with (abuts on) the lower end surface 641*a* of the support frame 64, and the second regions 630B having the second largest height H2 and the third regions 630C having the least height H3 face the lower end surface 641*a* of the support frame 64 with increasing gaps (distances) therebetween.

The plural ribs 637 of the pressure contact member 63 are in pressure contact with the lower end surface 641*a* of the support frame 64 in this state. As a result, the pressure contact member 63 and the support frame 64 tend to be flexed along the axial direction of the decurling roller 62 by the reaction force from the decurling roller 62.

However, the plural ribs 637 of the pressure contact member 63 in contact with the lower end portion 641*a* of the support frame 64 are set such that the protruding height H is larger at the center portion in the axial direction of the decurling roller 62 than at both end portions (H1>H2>H3). Therefore, the pressure contact member 63 that receives the reaction force from the decurling roller 62 is brought into pressure contact with the support frame 64 so that the pressure contact force (reaction force) is larger at the center portion in the axial direction of the decurling roller 62 than at both end portions.

According to the decurling device 60, as illustrated in FIG. 10, even when the first protruding portion 631 of the pressure contact member 63 is brought into pressure contact with the surface of the decurling roller 62 with a relatively large pressure contact force, the flexural deformation of the pressure contact member 63 and the support frame 64 in the axial direction of the decurling roller 62 is cancelled by an effect of the center portion of the decurling roller 62 in the axial direction being in pressure contact with the support frame 64 with a larger pressure contact force (reaction force) than the both end portions, and as illustrated in FIG. 19B, the occurrence of a fluctuation of the pressure contact force in the axial direction of the decurling roller 62 is prevented.

Accordingly, in the decurling device 60, the pressure contact force between the decurling belt 61 and the decurling roller 62 is greatly different between the center portion and the both end portions in the longitudinal direction, and it is possible to prevent wrinkles from being generated in the recording sheet 5 or skew from being generated in the recording sheet 5 due to a difference in the deformation amount of the elastic body layer 622 of the decurling roller 62.

In the decurling device 60, as illustrated in FIG. 13, even when the first and second protruding portions 631 and 632 come into contact with the surface of the decurling roller 62 with the relatively small pressure contact force via the decurling belt 61, the plural ribs 637 of the pressure contact member 63 and the lower end surface 641*a* of the support frame 64 are in contact with each other only at the center portion in the axial direction of the decurling roller 62, and the pressure contact force acts along the longitudinal direction of the pressure contact member 63. Therefore, as illustrated in FIG. 19B, the fluctuation of the pressure contact force in the axial direction of the decurling roller 62 is prevented.

In the first exemplary embodiment, as illustrated in FIGS. 18A to 18C, the plural ribs 637 of the pressure contact member 63 have a linear shape (have the same height) in the center portion in the axial direction of the decurling roller 62. Therefore, when the plural ribs 637 of the pressure contact member 63 come into contact with the support frame 64, the pressure contact member 63 can be prevented from being inclined along the axial direction of the decurling roller 62, and the pressure contact member 63 can be brought into stable pressure contact with the surface of the decurling roller 62.

Further, in the first exemplary embodiment, since the lower end surface 641*a* of the support frame 64 including the sheet metal or the like may be formed in a linear shape (planar shape), processing of the support frame 64 is facilitated.

Second Exemplary Embodiment

Figure 20:
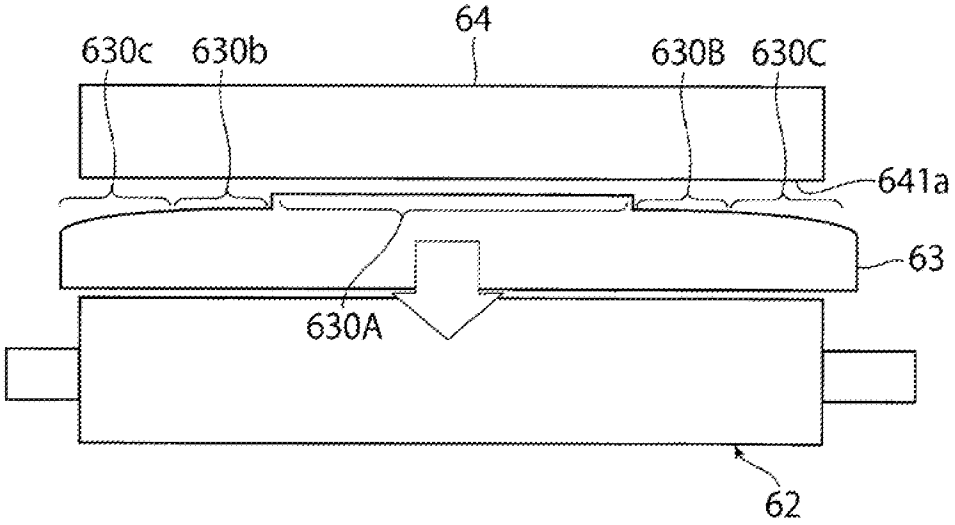
FIG. 20 is a schematic view illustrating a decurling device according to a second exemplary embodiment of the present disclosure.

FIG. 20 illustrates a decurling device according to a second exemplary embodiment of the present disclosure.

Unlike the first exemplary embodiment, the decurling device according to the second exemplary embodiment is configured such that both end portions of the contact portion of the pressure contact member 63 in the axial direction of the decurling roller 62 are formed in a curved shape rather than the configuration that the height H of the plural ribs 637 of the pressure contact member 63 in contact with the lower end surface 641*a* of the support frame 64 has a stepped shape over the entire length in the axial direction of the decurling roller 62.

In this manner, in the decurling device 60 according to the second exemplary embodiment described above, both end portions of the contact portion in the axial direction of the decurling roller 62 are formed in a curved shape. Therefore, when the decurling belt 61 is brought into pressure contact with the decurling roller 62 by the pressure contact member 63, it is possible to smoothly prevent the fluctuation of the pressure at both end portions in the axial direction of the decurling roller 62.

Other configurations and operations are the same as those of the first exemplary embodiment, and thus a description thereof will be omitted.

Third Exemplary Embodiment

Figure 21A:
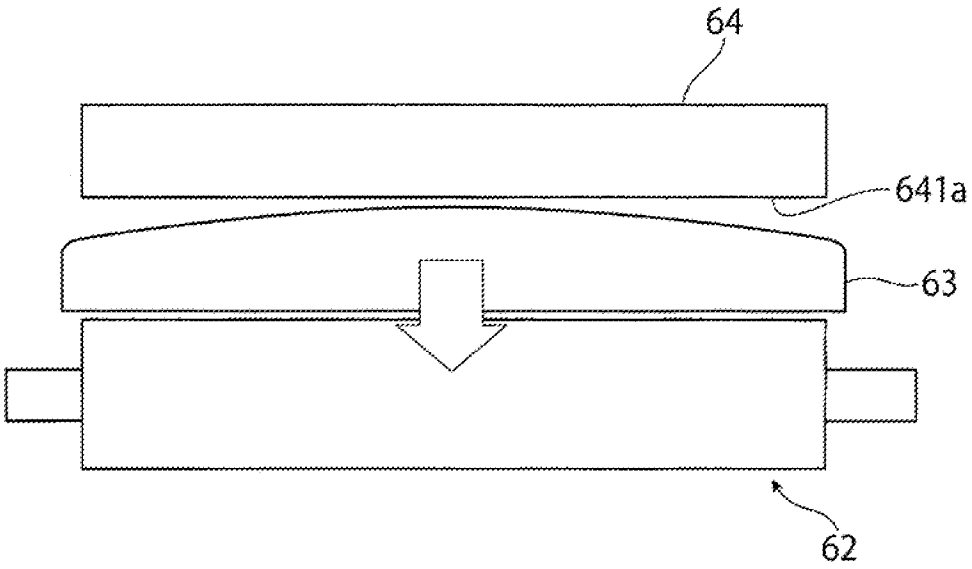
FIGS. 21A and 21B are schematic views illustrating a decurling device according to a third exemplary embodiment of the present disclosure.
Figure 21B:
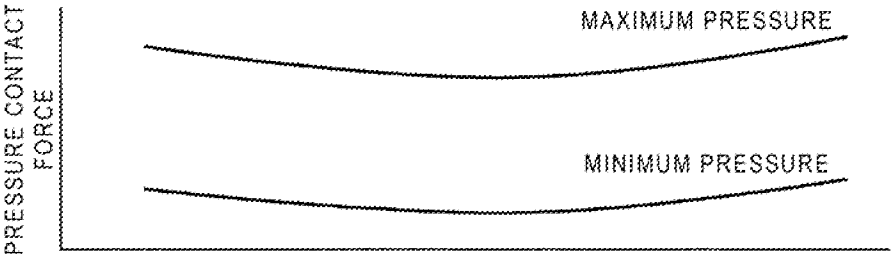

FIGS. 21A and 21B illustrate a decurling device according to a third exemplary embodiment of the present disclosure.

Unlike the first exemplary embodiment, the decurling device according to the third exemplary embodiment is configured such that the whole region of the contact portion of the pressure contact member 63 in the axial direction of the decurling roller 62 is formed in a curved shape rather than the configuration that the height H of the plural ribs 637 of the pressure contact member 63 in contact with the lower end surface 641*a* of the support frame 64 has a stepped shape over the entire length in the axial direction of the decurling roller 62.

In this manner, in the decurling device 60 according to the third exemplary embodiment described above, the whole region of the contact portion in the axial direction of the decurling roller 62 is formed in the curved shape. Therefore, when the decurling belt 61 is brought into pressure contact with the decurling roller 62 by the pressure contact member 63, it is possible to smoothly prevent the fluctuation of the pressure at the whole region of the contact portion in the axial direction of the decurling roller 62.

Other configurations and operations are the same as those of the first exemplary embodiment, and thus a description thereof will be omitted.

In the above exemplary embodiments, the image forming apparatus that forms a full-color image has been described as an example of the image forming apparatus. It is needless to say that the image forming apparatus is not limited thereto, and may be one that forms a monochrome image.

In the exemplary embodiments described above, the description has been made on the case where the center portion, in the axial direction of the rotary body, of the contact portion of the pressure contact unit among the pressure contact unit and the support unit further protrudes toward the support unit than both end portions thereof. It is noted that the present disclosure is not limited thereto. A center portion, in the axial direction of the rotary body, of the contact portion of the support unit or each of the contact portions, in the axial direction of the rotary body, of both the pressure contact unit and the support unit may further protrude toward the support unit than both end portions thereof.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A decurling device comprising:

a rotary body;

an endless correction belt configured to correct curl of a recording medium passing between the rotary body and the correction belt; and a pressure contact plate disposed inside the correction belt, an opposite surface of the pressure contact plate to the rotary body being supported by a support unit so as to be in pressure contact with the rotary body, wherein a center portion, in an axial direction of the rotary body, of at least one of a contact portion of the pressure contact plate or a contact portion of the support unit further protrudes toward the other of the contact portion of the pressure contact plate and the contact portion of the support unit than both end portions thereof.

2. The decurling device according to claim 1, wherein the contact portion of the pressure contact plate with the support unit protrudes toward the support unit.

3. The decurling device according to claim 2, wherein the center portion, in the axial direction of the rotary body, of the contact portion of the pressure contact plate is formed in a linear shape.

4. The decurling device according to claim 3, wherein the contact portion of the pressure contact plate with the support unit protrudes stepwise along the axial direction of the rotary body.

5. An image forming apparatus comprising:

an image forming unit configured to form an image on a recording medium;

a fixing unit configured to fix the image onto the recording medium; and the decurling device according to claim 4.

6. An image forming apparatus comprising:

an image forming unit configured to form an image on a recording medium;

a fixing unit configured to fix the image onto the recording medium; and the decurling device according to claim 3.

7. An image forming apparatus comprising:

an image forming unit configured to form an image on a recording medium;

a fixing unit configured to fix the image onto the recording medium; and the decurling device according to claim 2.

8. The decurling device according to claim 1, wherein the pressure contact plate comprises:

a first pressure contact portion disposed downstream in a moving direction of the recording medium, and a second pressure contact portion disposed upstream in the moving direction of the recording medium.

9. The decurling device according to claim 8, wherein a pressure contact force of the first pressure contact portion to the rotary body is larger than a pressure contact force of the second pressure contact portion to the rotary body.

10. The decurling device according to claim 9, wherein the pressure contact plate is switched between a first state in which only the first pressure contact portion is in pressure contact with the rotary body and a second state in which the first and second pressure contact portions are in pressure contact with the rotary body.

11. An image forming apparatus comprising:

an image forming unit configured to form an image on a recording medium;

a fixing unit configured to fix the image onto the recording medium; and the decurling device according to claim 10.

12. An image forming apparatus comprising:

an image forming unit configured to form an image on a recording medium;

a fixing unit configured to fix the image onto the recording medium; and the decurling device according to claim 9.

13. The decurling device according to claim 8, wherein the pressure contact plate is switched between a first state in which only the first pressure contact portion is in pressure contact with the rotary body and a second state in which the first and second pressure contact portions are in pressure contact with the rotary body.

14. An image forming apparatus comprising:

an image forming unit configured to form an image on a recording medium;

a fixing unit configured to fix the image onto the recording medium; and the decurling device according to claim 13.

15. An image forming apparatus comprising:

an image forming unit configured to form an image on a recording medium;

a fixing unit configured to fix the image onto the recording medium; and the decurling device according to claim 8.

16. The decurling device according to claim 1, wherein the support unit comprises a sheet metal that has a substantially L-shaped cross section and that is disposed on a back surface side of the pressure contact plate.

17. The decurling device according to claim 16, wherein the contact portion of the support unit with the pressure contact plate is flat.

18. An image forming apparatus comprising:

an image forming unit configured to form an image on a recording medium;

a fixing unit configured to fix the image onto the recording medium; and the decurling device according to claim 17.

19. An image forming apparatus comprising:

an image forming unit configured to form an image on a recording medium;

a fixing unit configured to fix the image onto the recording medium; and the decurling device according to claim 16.

20. An image forming apparatus comprising:

an image forming unit configured to form an image on a recording medium;

a fixing unit configured to fix the image onto the recording medium; and the decurling device according to claim 1.

* * * * *